US007877825B1

(12) United States Patent
Marshall et al.

(10) Patent No.: US 7,877,825 B1
(45) Date of Patent: Feb. 1, 2011

(54) CORNER CONNECTOR AND METHOD FOR CONNECTING HEADERS OF TWO SIDES OF A SHOWER ENCLOSURE OR TUB/SHOWER ENCLOSURE

(76) Inventors: Danny Ray Marshall, 35900 Gerard Dou St., Winchester, CA (US) 92596; Richard G. Kluge, W1461 Maureen Ct., Lake Geneva, WI (US) 53147

( * ) Notice: Subject to any disclaimer, the term of this patent is extended or adjusted under 35 U.S.C. 154(b) by 1236 days.

(21) Appl. No.: 11/486,739

(22) Filed: Jul. 14, 2006

(51) Int. Cl.
*A47K 3/00* (2006.01)

(52) U.S. Cl. ..... 4/612

(58) Field of Classification Search ..... 4/612, 4/614, 610, 506, 513, 488; 52/656.9, 655.1; 403/171, 176
See application file for complete search history.

(56) References Cited

U.S. PATENT DOCUMENTS 1,656,410 A * 1/1928 Baer et al. ..... 4/614
2,282,329 A * 5/1942 Johnson ..... 52/264
3,101,817 A * 8/1963 Radek ..... 52/241
3,353,854 A * 11/1967 Hansen ..... 403/171
3,512,326 A * 5/1970 Greene ..... 52/716.2
4,152,789 A * 5/1979 Heath ..... 4/614
4,738,069 A * 4/1988 Williams ..... 52/658
6,817,144 B1 * 11/2004 Tavivian ..... 52/35
7,036,283 B2 * 5/2006 Halas ..... 52/311.1
2006/0225378 A1 * 10/2006 Hu ..... 52/648.1

OTHER PUBLICATIONS

Chaparral™ Signature Series Shower Doors 252,352 Shower Door with Continuous Hinge & 90° Return Installation Instructions. Illustration of Parts Breakdown [2 sheets].
Drawing A.

* cited by examiner

*Primary Examiner*—Gregory L. Huson
*Assistant Examiner*—Janie Christiansen
(74) *Attorney, Agent, or Firm*—Cook Alex Ltd.

(57) ABSTRACT

A top corner connector is provided for a shower enclosure or tub/shower enclosure. The connector includes first and second legs which have an interior cavity opening downwardly and opening lengthwise at the end. Each leg is adapted to receive a portion of a header at the top of the enclosure. The corner connector and headers can be secured together and at least the corner connector can be secured to the top end of a vertical corner post at a corner of the enclosure. A method is provided for efficiently connecting the headers at the top of the enclosure with the corner connector.

12 Claims, 17 Drawing Sheets

CORNER CONNECTOR AND METHOD FOR CONNECTING HEADERS OF TWO SIDES OF A SHOWER ENCLOSURE OR TUB/SHOWER ENCLOSURE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a connector and method for connecting the headers of two sides of the top of a shower enclosure or tub/shower enclosure. The invention can optionally be employed also to connect sills at the bottom of the enclosure.

BACKGROUND OF THE INVENTION AND TECHNICAL PROBLEMS POSED BY THE PRIOR ART

A residential shower may be installed at the corner of two existing walls which typically extend between the floor and ceiling of a bathroom. In one common type of installation, such a shower is enclosed by installing a partition structure having two sides wherein one of the partition sides extends out from one of the existing corner walls, and the other of the partition sides extends out from the other existing corner wall so that the two partition sides meet and are connected at a vertical corner. The conventional enclosure partition structure typically includes (a) a vertical wall frame member (i.e., "wall jamb") mounted to one of the existing corner walls, (b) another wall jamb mounted to the other existing corner wall, (c) a vertical, outside, corner frame member (i.e., a "corner post"), (d) a pair of horizontal, bottom frame members (i.e., "sills") connected with an internal connecting bracket, (e) a pair of horizontal, top frame members (i.e., "headers") connected with an internal connecting bracket), and (f) glass or plastic panels extending between the sills and headers. Such a typical shower enclosure usually includes one or more glass panels that occupy most of the height and width of the one partition side, and includes a glass panel door which comprises some or most of the height and width of the other partition side.

A shower can also be installed at the corner of a room over a bathtub wherein the head or faucet end of the bathtub is located against one of the existing corner walls, and one side of the bathtub is located against the other of the existing corner walls. The foot end of the bathtub and the other side of the bathtub may be exposed to the interior of the room. In such a design, the shower and inside area of the bathtub can be enclosed with two partition sides—one partition side extending from one of the existing walls and running along the top of the free side of the bathtub, and the other partition side extending from the other existing wall and running along the top of the foot end of the bathtub so as to define, in conjunction with the room's two, existing, corner walls, a rectangular enclosure. The partition structure on the bathtub includes the above-described wall jambs, corner post, sills, and headers. The partition structure on the side of the bathtub typically includes a door system which may consist of a pair of bypass, sliding doors or perhaps a flexible, accordion type door.

As described above, conventional partition enclosures for either an existing corner wall shower installation, or an existing corner wall tub/shower installation typically include a number of different frame members, one or more fixed glass panels, and at least one door. Installation of such conventional enclosure systems typically requires precise measurements to be made and precise cuts to be made on lengths of at least some of the frame stock pieces in order to provide headers having the appropriate lengths for installation.

A manufacturer of a partition shower enclosure system typically provides each of the two, vertical jambs manufactured to a standard height (e.g., 60 inches, 72 inches, etc.).

The manufacturer typically furnishes each of the two, bottom sills to the installer pre-cut so that each sill has one mitered end and has a length corresponding to one of several standard size enclosure configurations.

The horizontal, top, frame members for the headers are each furnished by the manufacturer with one mitered end, but the manufacturer typically provides each such mitered header to the installer in an "over cut" condition wherein each header is somewhat longer than the corresponding sill at the bottom. As will next be explained, this provides the installer with the capability for making precise length adjustments to the headers in the field (i.e., at the installation site) in order to accommodate variations in the existing, vertical corner walls which may not be straight or plumb along their heights.

The installer first secures the mitered ends of the bottom, horizontal sills together with an internal corner bracket that has two legs—one leg extending into the mitered end of one sill, and the other leg extending into the mitered end of the other sill. A typical, conventional bracket is a flat aluminum angle with unthreaded bores in each leg. Each sill mitered end is slid onto a leg of the corner bracket. Each sill is open along the bottom. From the underside of the subassembly of the bracket and two sills, the installer can drill through the exposed, corner bracket bores into a mounting surface inside the sill to provide tap holes for screwing each leg of the corner bracket to the sill. The connected sills are then anchored to the floor or curb (or bathtub) at the appropriate location so that each sill extends to one of the wall jambs.

The installer next installs the vertical frame members or wall jambs—one jamb mounted vertically to one existing corner wall and extending down into one of the sills, and one jamb mounted vertically to the other existing corner wall and extending down into the other sill. Then the stationary glass panel is placed in one of the sills and adjacent jamb. The corner post is then properly positioned on the connected corner of the sills and along the vertical margin of the stationary glass panel in a vertical, plumb orientation so that accurate measurements can be taken along the tops of the components from each existing corner wall to the corner post. Because each header has been provided by the manufacturer with one corner miter cut end and with a length greater than the length of the corresponding sill, the installer must cut each header to the proper length by cutting away a portion of the non-mitered end of the header so that the cut end can properly abut one of the existing corner walls. After each of the two headers has been cut to the proper length, a corner bracket (e.g., a flat aluminum angle with unthreaded bores) is used to join the two headers together at the miter cut ends. To do this, each header miter cut end is slid onto a leg of the corner bracket. Each header is open along the bottom. From the underside of the subassembly of the bracket and two headers, the installer can drill through the exposed, corner bracket bores into a mounting surface inside the header to provide tap holes for screwing each leg of the corner bracket to the header.

The header subassembly of the bracket and two headers can then be placed on the top of the previously installed wall jambs and panel components, and then secured to the wall jambs and corner post. Then the door assembly can be installed, the strike jamb can be installed, glazing can be installed, a drip rail can be installed, and exposed edges and joints can be caulked.

The above-described conventional partition enclosure and installation method requires proper measurement and cutting by the installer, and this adds to the time and complexity of the installation process. It would be desirable to provide an improved corner connector and method for connecting headers of two sides of a shower enclosure or tub/shower enclosure wherein such an improved method would not require the installer to cut one or more headers in the field at the installation site. Further, it would be desirable to provide such an improved system and installation method that would not require measurements of the components at least along the top of the enclosure.

It would also be advantageous if the same type of improved corner connector could also optionally be used to connect sills at the bottom of the enclosure.

The present invention provides an improved corner connector and method for connecting headers of two sides of a shower enclosure or tub/shower enclosure wherein the improved connector and method can accommodate designs having the above-discussed benefits and features.

BRIEF SUMMARY OF THE INVENTION

According to one aspect of the invention, a corner connector is provided for use at least at the top of an enclosure for a shower or a tub/shower wherein the enclosure has at least (a) a generally horizontal first header, (b) a generally horizontal second header, (c) a generally vertical first jamb at a first existing first wall, (d) a generally vertical second jamb at a second existing wall, and (e) a generally vertical corner post that (i) has a first attachment portion extending toward the first existing wall, (ii) has a second attachment portion extending toward the second existing wall, and (iii) terminates in a top end.

The corner connector comprises a first leg and a second leg. The first leg has a proximal end, a distal end, and an interior cavity. The interior cavity (i) is open at the first leg distal end, (ii) is also open downwardly between the first leg distal end and the first leg proximal end, and (iii) is sized to receive both the top end of the corner post first attachment portion and a selected length of an end portion of the first header when the first header is inserted lengthwise into the first leg cavity so as to minimize non-lengthwise movement of the first header relative to the first leg.

The second leg has a proximal end, a distal end, and an interior cavity. The interior cavity (i) is open at the second leg distal end, (ii) is also open downwardly between the second leg distal end and the second leg proximal end, and (iii) is sized to receive both the top end of the corner post second attachment portion and a selected length of an end portion of the second header when the second header is inserted lengthwise into the second leg cavity so as to minimize non-lengthwise movement of the second header relative to the second leg.

In a preferred embodiment, the corner connector first leg and second leg each has a pair of sidewall portions connected by a top portion. The first leg sidewall portions each has a lower flange extending toward the other lower flange for being received under a portion of the first header. The corner connector second leg sidewall portions each has a lower flange extending toward the other lower flange for being received under a portion of the second header.

The corner connector first leg proximal end is a mitered end, and the corner connector second leg proximal end is a mitered end that is in end-to-end abutting relationship with the first leg mitered end. The corner connector includes a joining plate adhesively secured to the corner bracket first leg top portion and to the corner bracket second leg top portion.

According to an optional further aspect of the invention, the corner connector can also be used at the bottom of an enclosure to connect two sills.

According to another aspect of the invention, a method is provided for connecting headers at the top of an enclosure for a shower or a tub/shower wherein the enclosure has at least (a) a generally horizontal first header, (b) a generally horizontal second header, (c) a generally vertical first jamb at a first existing wall, (d) a generally vertical second jamb at a second existing wall, and (e) a generally vertical corner post that (i) has a first attachment portion extending toward the first existing wall, (ii) has a second attachment portion extending toward the second existing wall, and (iii) terminates in a top end.

The method comprises the steps of (A) providing a corner connector that includes a first leg and a second let wherein the first leg has a proximal end, a distal end, and an interior cavity that (i) is open at the first leg distal end, (ii) is also open downwardly between the first leg distal end and the first leg proximal end, and (iii) is sized to receive both the top end of the corner post first attachment portion and a selected length of an end portion of the first header when the first header is inserted lengthwise into the first leg cavity so as to minimize non-lengthwise movement of the first header relative to the first leg; and wherein a second leg has a proximal end, a distal end, and an interior cavity that (i) is open at the second leg distal end, (ii) is also open downwardly between the second leg distal end and the second leg proximal end, and (iii) is sized to receive both the top end of the corner post second attachment portion and a selected length of an end portion of the second header when the second header is inserted lengthwise into the second leg cavity so as to minimize non-lengthwise movement of the second header relative to the second leg;

(B) creating a top subassembly by (i) inserting an end portion of the first header partway into the corner connector first leg, and (ii) before, during, or after step (B)(i), inserting an end portion of the second header partway into the corner connector second leg;

(C) mounting the top subassembly at the top end of the corner post so that (i) the top end of the corner post first attachment portion is received in the corner connector first leg interior cavity, and (ii) the top end of the corner post second attachment portion is received in the corner connector second leg interior cavity;

(D) extending the first header relative to the corner connector to engage the first existing wall, and mounting the extended first header on the first jamb;

(E) before, during, or after step (D), extending the second header relative to the corner connector to engage the second existing wall, and mounting the extended second header on the second jamb;

(F) before, during, or after either or both of steps (D) and (E), securing the corner connector to the corner post;

(G) before, during, or after step (F), but after steps (A)-(E), securing the first and second headers to the enclosure first and second jambs, respectively; and (H) before, during, or after step (G), but after steps (A)-(E) securing the corner connector first and second legs to the first and second headers, respectively.

In a preferred form of the method, step (F) is performed after steps (D) and (E); step (G) is performed after step (F); and step (H) is performed after step (G).

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 9 is fragmentary, a cross-sectional view taken generally along the plane 9-9 in

FIG. 5;

DETAILED DESCRIPTION

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

Figures illustrating the invention show some mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

Figure 1:
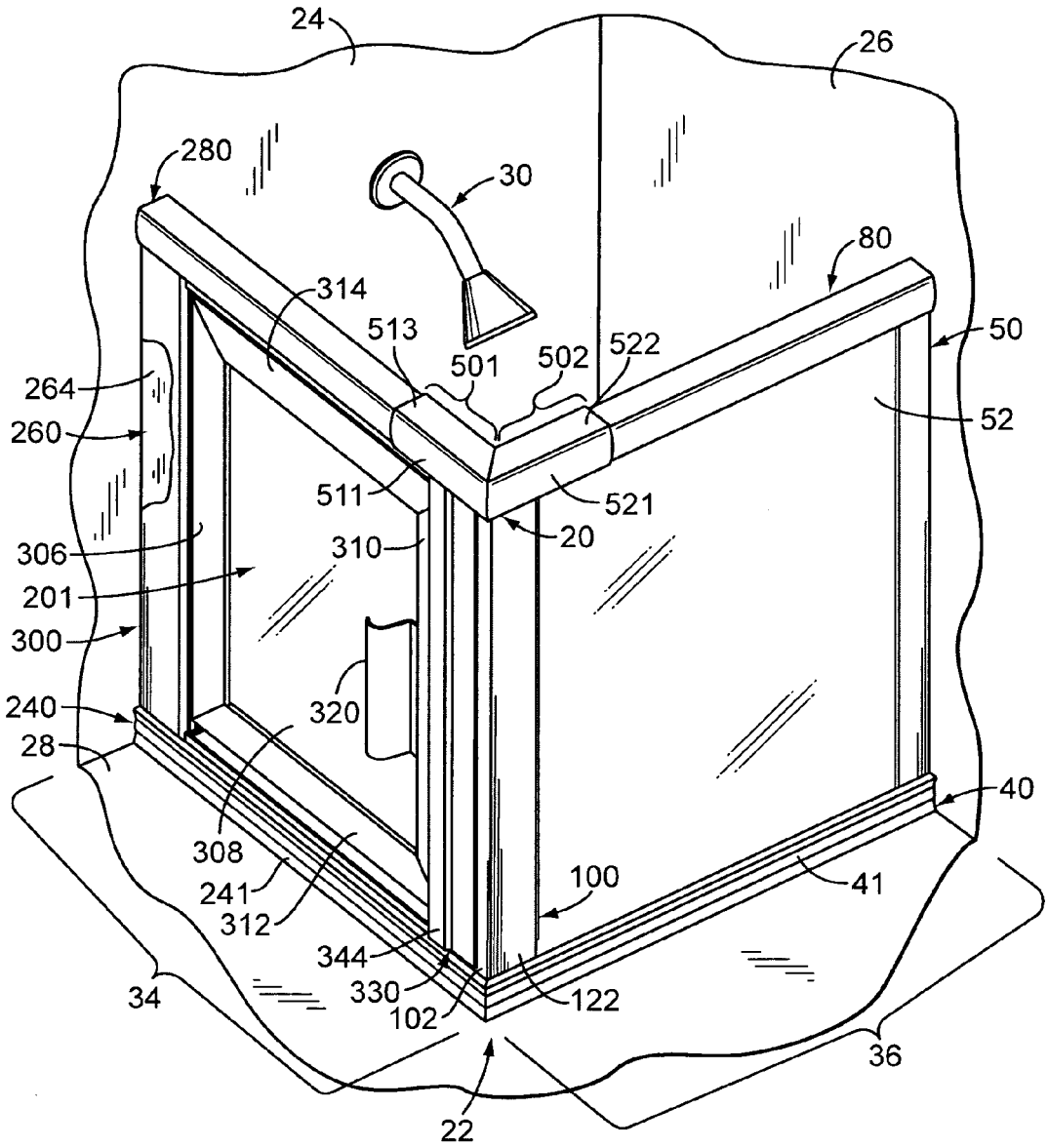
FIG. 1 is simplified, fragmentary, isometric view of a preferred embodiment of the corner connector of the present invention shown at the top, outside corner of an enclosure for a shower which is located in the corner of two existing walls in a building, such as a residence, commercial building, etc.

One aspect of the present invention resides in a novel, corner connector which is designated in FIG. 1 by the reference number 20 and which is installed at the top of a shower enclosure 22. Such an installation would be typical of a residential bathroom wherein the bathroom walls include a first wall 24 and a second wall 26 which typically extend between the bathroom floor 28 and the bathroom ceiling (not visible).

In an optional use of the corner connector 20 of the present invention, the corner connector 20 could also be used at the bottom of the enclosure 22 (if the enclosure bottom sills (discussed hereinafter) and the corner connector 20 have appropriate shapes to allow the corner connector 20 to appropriately receive portions of each bottom sill), but that optional arrangement is not illustrated.

Although the design details of many of the components of the enclosure 22 form no part of the present invention, the enclosure components will next be briefly described.

In FIG. 1, a shower head 30 is shown projecting from the first existing wall 24. The enclosure 22 may be characterized as a partition structure having two sides wherein one of the partition sides 34 extends out from the first existing wall 24, and wherein the other partition side 36 extends out from the other existing wall 26 so that the two partition sides 34 and 36 meet and are connected along a vertical corner, the top of which is defined in part by the corner connector 20.

The enclosure 22 need not be mounted directly on a floor 28. In one alternate form of the installation (not shown), the enclosure 22 can be installed at the corner of a room over a generally rectangular bathtub wherein the head end or faucet end of the bathtub is located against one of the existing corner walls (e.g., such as wall 24 illustrated in FIG. 1), and one side of the bathtub is located against the other wall (such as wall 26 illustrated in FIG. 1). In such an alternate form of the enclosure installation, the first side of the enclosure would extend from one of the walls (e.g., wall 24 in FIG. 1) and run along the top of the free side of the bathtub. The other side of the enclosure would extend from the other existing wall (e.g., wall 26 in FIG. 1) and run along the foot end of the bathtub. The two sides of such an enclosure on a bathtub, in conjunction with the two, existing, corner walls of the room, would define a rectangular enclosure.

Figure 13:
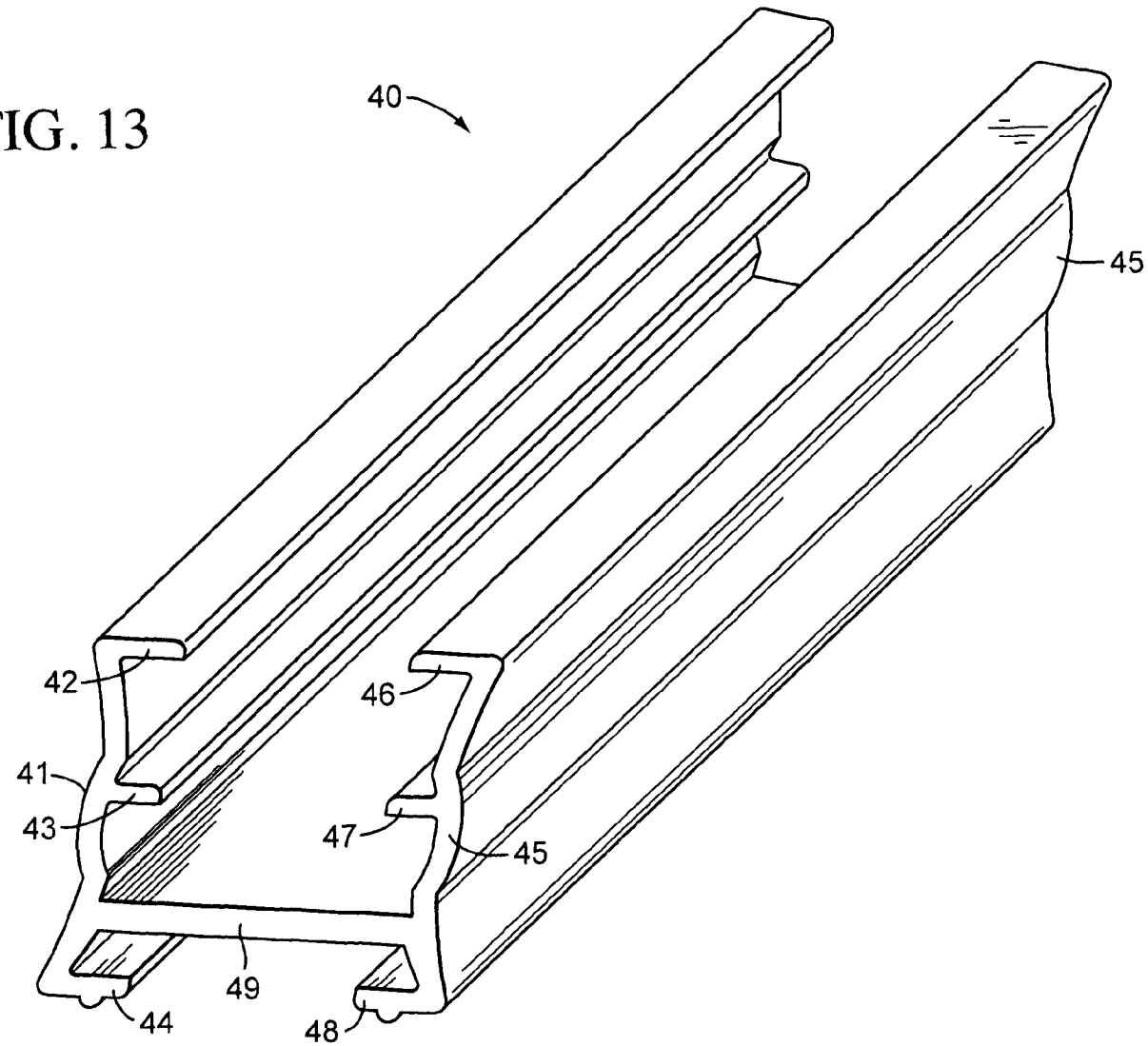
FIG. 13 is an isometric view of a bottom sill used in the enclosure.

As can be seen in FIGS. 1, 2, 5, and 6, the side 36 includes a bottom sill 40 which runs along the floor and is sealed therealong by suitable caulking material (not illustrated). As can be seen in FIGS. 7 and 13, the bottom sill 40 has an interior wall 41 which is on the interior of the enclosure and is exposed to the shower water. The interior wall 41 includes an upper horizontal flange 42, a middle flange 43, and a bottom flange 44. The bottom sill 40 also includes an exterior wall 45 defining a top flange 46, a middle flange 47, and a bottom flange 48. The interior wall 41 and exterior wall 45 are joined by a deck, floor, or cross wall 49.

Figure 2:
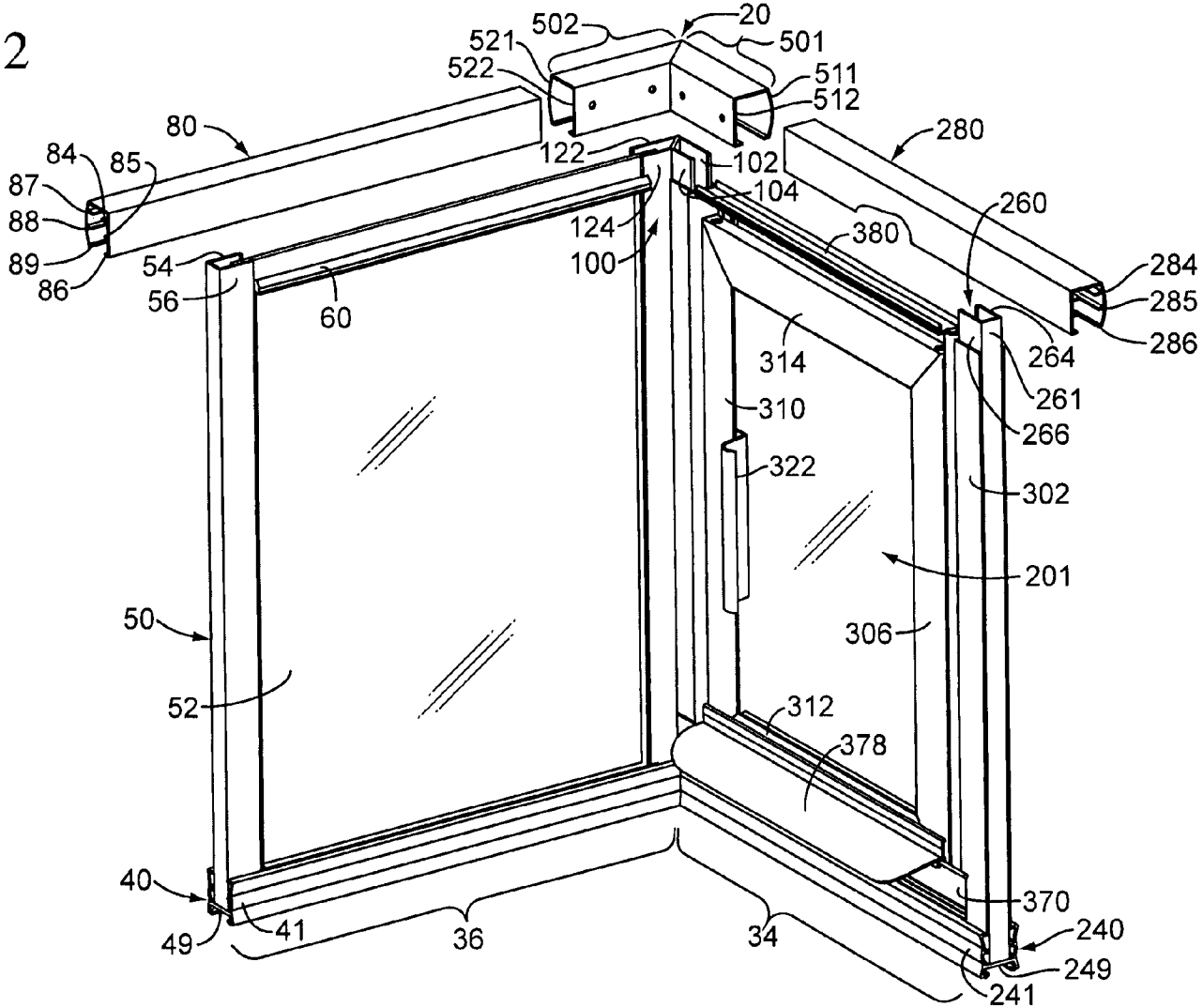
FIG. 2 is a simplified, isometric view of the enclosure from the inside with the floor and walls omitted for ease of illustration, and components at the top of the enclosure have been exploded upwardly to reveal certain details.
Figure 3:
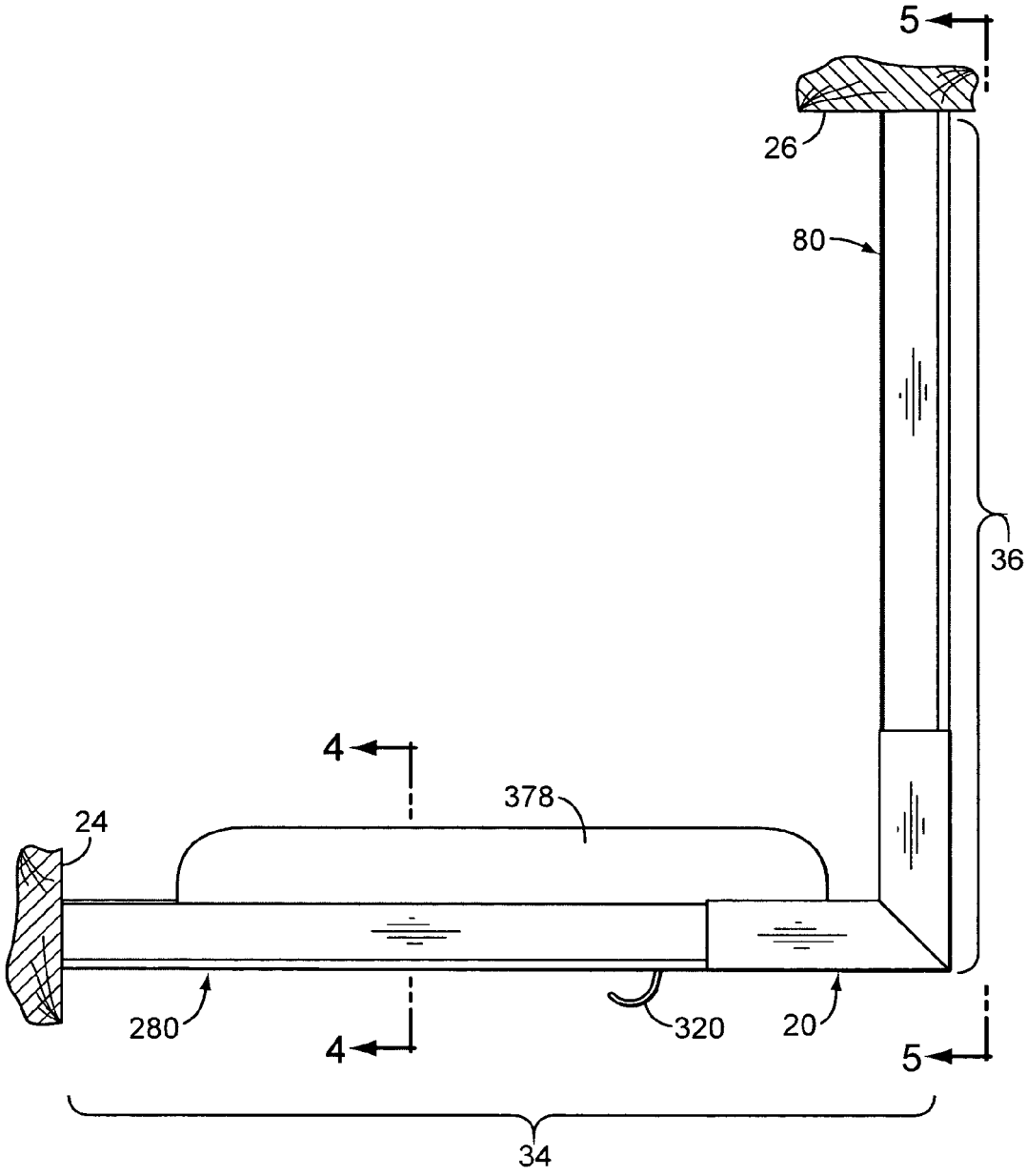
FIG. 3 is a top plan view of the enclosure with the existing walls shown in fragmentary cross section and with the floor omitted for ease of illustration.

As can be seen in FIGS. 1, 2, and 7, the enclosure side 36 includes a generally vertical jamb 50. The bottom of the jamb 50 is mounted in the sill 40, and the jamb 50 is typically secured to the existing wall 26 with suitable screws (not visible). Such screws may be received in suitable anchors (not illustrated) in the wall 26. The inside vertical corner of the jamb 50 at the wall 26 is preferably sealed with a suitable caulk (not shown). Before the jamb 50 is attached to the wall 26, the bottom end of the jamb 50 is mounted on the deck 49 of the sill 40 (FIG. 2).

As can be seen in FIG. 7, the enclosure side 36 also preferably includes a fixed or stationary panel, such as a glass panel 52 which is glazed at the bottom sill 40 with a pair of glazing strips 60 which are typically made from a polyvinyl material and have an appropriate cross section to be retained within the bottom sill for sealing against the glass panel 52. The bottom of the glass panel 52 may rest upon small support members (not shown), such as polyvinyl chloride setting blocks which are disposed inside the bottom sill 40.

Figure 8:
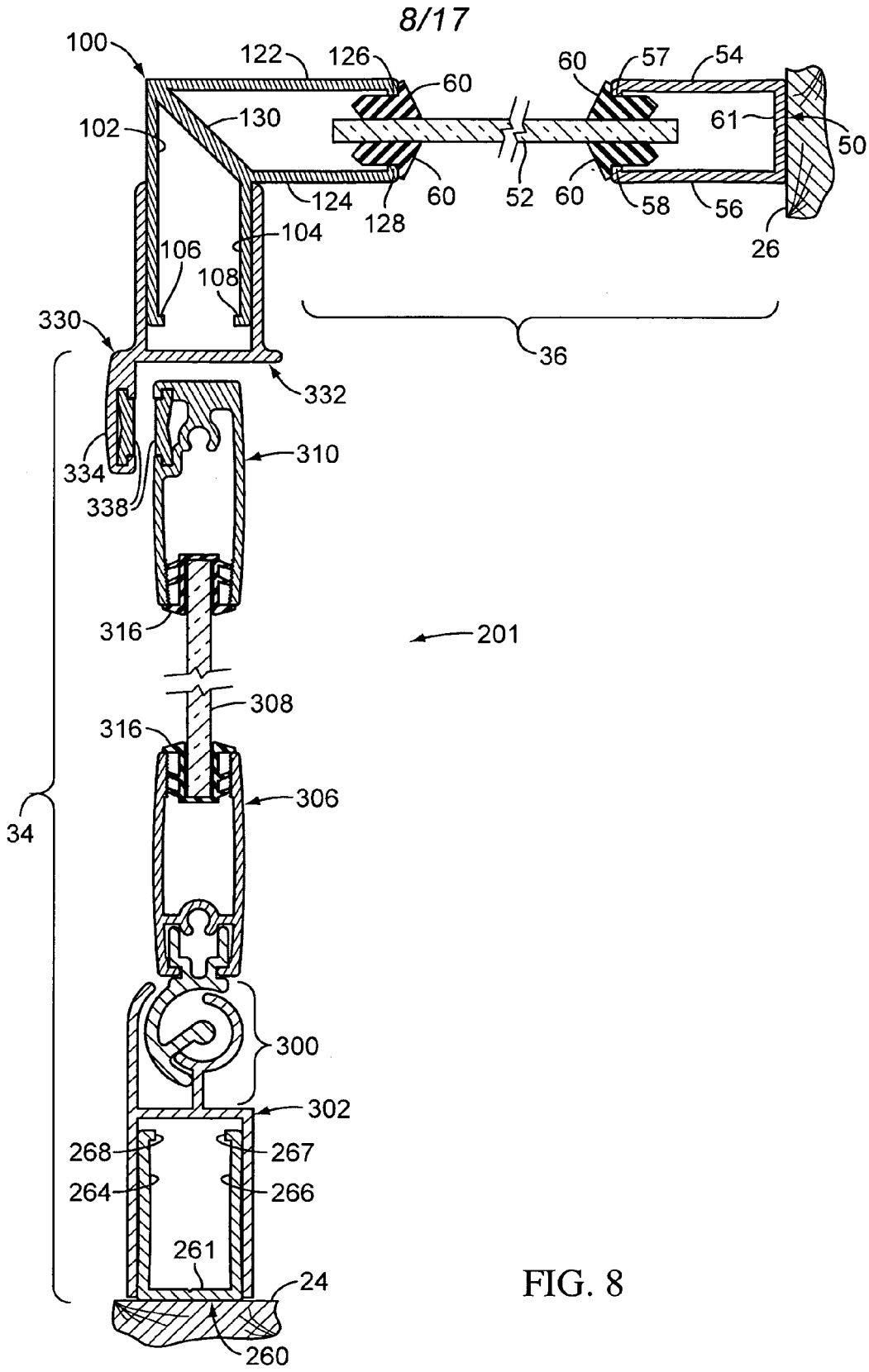
FIG. 8 is a fragmentary, cross-sectional view taken generally along the plane 8-8 in FIG. 5 looking up, and the upper background details have been omitted from FIG. 8 for clarity.

One vertical, end margin of the glass panel 52 is received within the jamb 50 (FIGS. 2 and 8). To this end, and as can be seen in FIGS. 2 and 8, the transverse cross section of the jamb 50 has a generally U-shaped configuration defining an exterior wall or leg 54 and an interior wall or leg 56. As can be seen in FIG. 8, the wall 54 of the jamb 50 at the wall 26 has a vertically disposed, projecting lip or flange 57, and the other jamb wall 56 has a vertically disposed, projecting lip or flange 58. The walls 54 and 56 are joined by a rear wall 61 through which the jamb mounting screws (not illustrated) extend into the wall 26. The glass panel 52 is secured and sealed to the jamb 50 with a pair of vertically disposed, vinyl glazing strips 60 as illustrated in FIG. 8.

Figure 14:
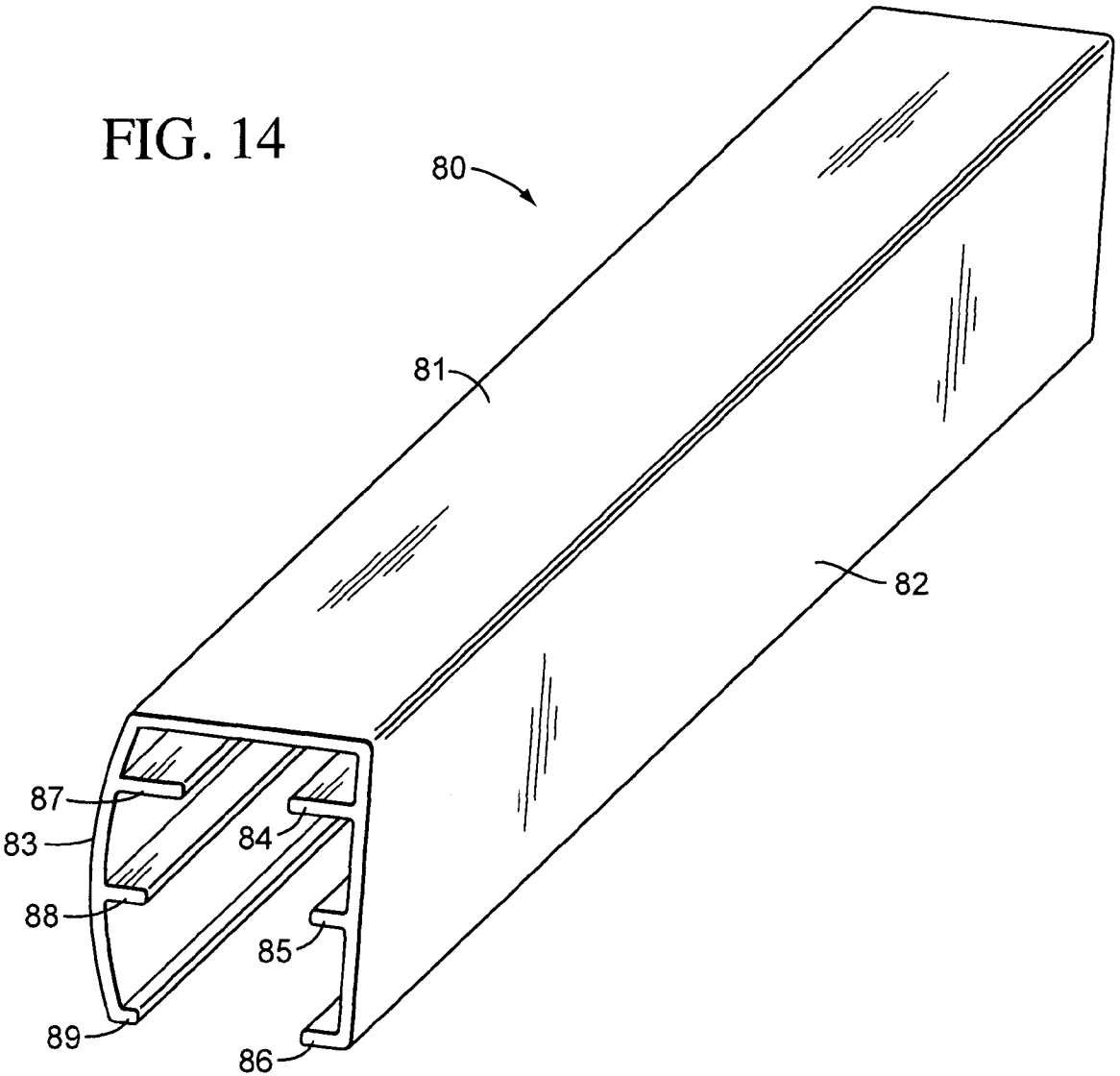
FIG. 14 is an isometric view of a header used in the enclosure.

As shown in FIG. 7, the upper portion of the glass panel 52 is received in a header 80 and sealed therein with vinyl glazing strips 60 on each side of the glass panel 52. As shown in FIG. 14, the header 80 has a generally inverted, U-shaped cross-section defined by a top deck or wall 81, an interior wall 82, and an exterior wall 83. In the embodiment illustrated in FIG. 14, the top wall 81 is generally flat and planar. When the header 80 is installed, the top wall 81 is generally horizontal and parallel to the floor. The header interior wall 82 is generally planar and vertically disposed relative to the header top wall 81. The header exterior wall 83 is generally vertically disposed, but is curved or convex outwardly to provide an aesthetically pleasing configuration.

The header interior wall 82 includes a laterally projecting top flange 84, a laterally projecting middle flange 85, and a laterally projecting bottom flange 86. The header exterior wall 83 includes a laterally projecting top flange 87, a laterally projecting middle flange 88, and a laterally projecting bottom flange 89. With reference to FIG. 7, the top end of the wall jamb 50 is received inside the header 80 so that the header top flanges 84 and 87 rest on the top of the jamb 50 and so that the middle flanges 85 and 88 and the bottom flanges 86 and 89 provide lateral restraint and stability.

As can be seen in FIG. 1, the enclosure side 36 extends from the wall 26 toward the enclosure other side 34 where they meet at a vertical corner post 100. The corner post 100 may be regarded as having two attachment portions which each extends toward one of the existing walls. With reference to FIG. 8, the corner post first attachment portion extends toward the first wall 24 and is defined by a pair of generally parallel, spaced-apart members or walls—an exterior wall 102, and an interior wall 104. The exterior wall 102 includes a vertical end flange or lip 106, and the interior wall 104 includes a vertical end flange or lip 108.

The other member or attachment portion of the corner connector 100, which extends toward the second wall 26, includes an exterior wall 122 and an interior wall 124. The exterior wall 122 includes a vertical end lip or flange 126, and the interior wall 124 includes a vertical end lip or flange 128.

As can be seen in FIG. 8, the corner post 100 is structurally strengthened or rigidified by an interior cross wall 130 which extends between the junction of the interior walls 104 and 124 and the junction of the exterior walls 102 and 122.

As can be seen in FIGS. 2 and 8, one vertical margin of the glass panel 52 is received within the corner post 100. In particular, the glass panel 52 is received in the corner post second attachment portion between the exterior member or wall 122 and the interior member or wall 124. A vertically disposed, vinyl glazing strip 60 is provided on each side of the glass panel 52 and engaged with an adjacent member or wall of the corner post 100 to secure the glass panel 52 in the corner post 100 with a liquid-tight seal.

The enclosure side 34 (FIG. 1) has a structure which is somewhat similar to the side 36, but the side 34 includes a hinged door or door assembly 201 which, in this illustrated embodiment, is adapted to open inwardly. However, it will be understood that the enclosure could be designed to permit the door to open outwardly rather than inwardly. The opening configuration of the door 201 forms no part of the present invention. Indeed, depending on the length of the enclosure side 34, the door could be replaced by a pair of hanging sliding doors or a pair of rolling doors, or by just one hanging sliding door or one rolling door.

In the illustrated embodiment, the door 201 occupies most of the entire width of the enclosure side 34. In a modification wherein there is a greater distance between the wall 24 and the corner post 100, a stationary panel could be provided in addition to the door 201.

As can be seen in FIG. 1, the door 201 is mounted over a bottom sill 240 which has a cross-sectional configuration identical with that of the previously described other sill 40 which is installed at the bottom of the enclosure side 36.

Figure 4:
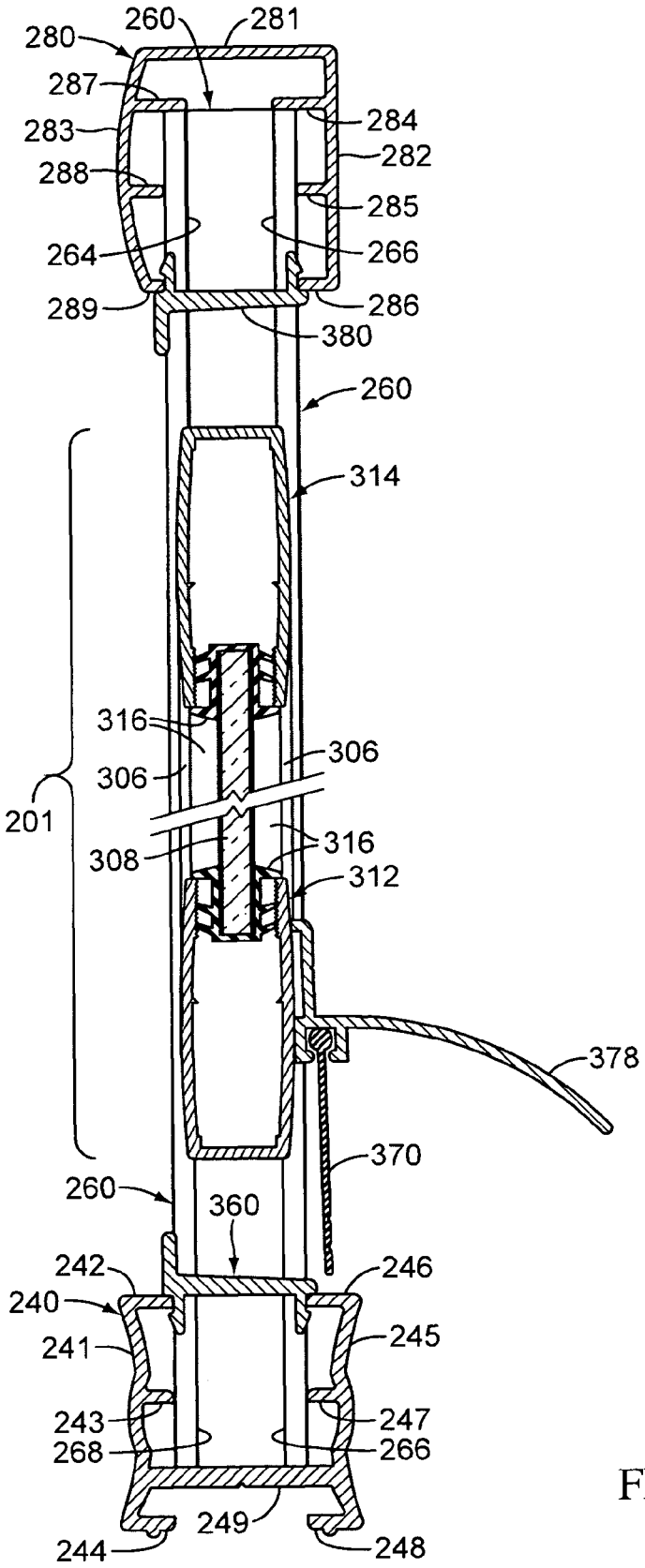
FIG. 4 is a greatly enlarged, cross-sectional view taken generally along the plane 4-4 in FIG. 3.
Figure 5:
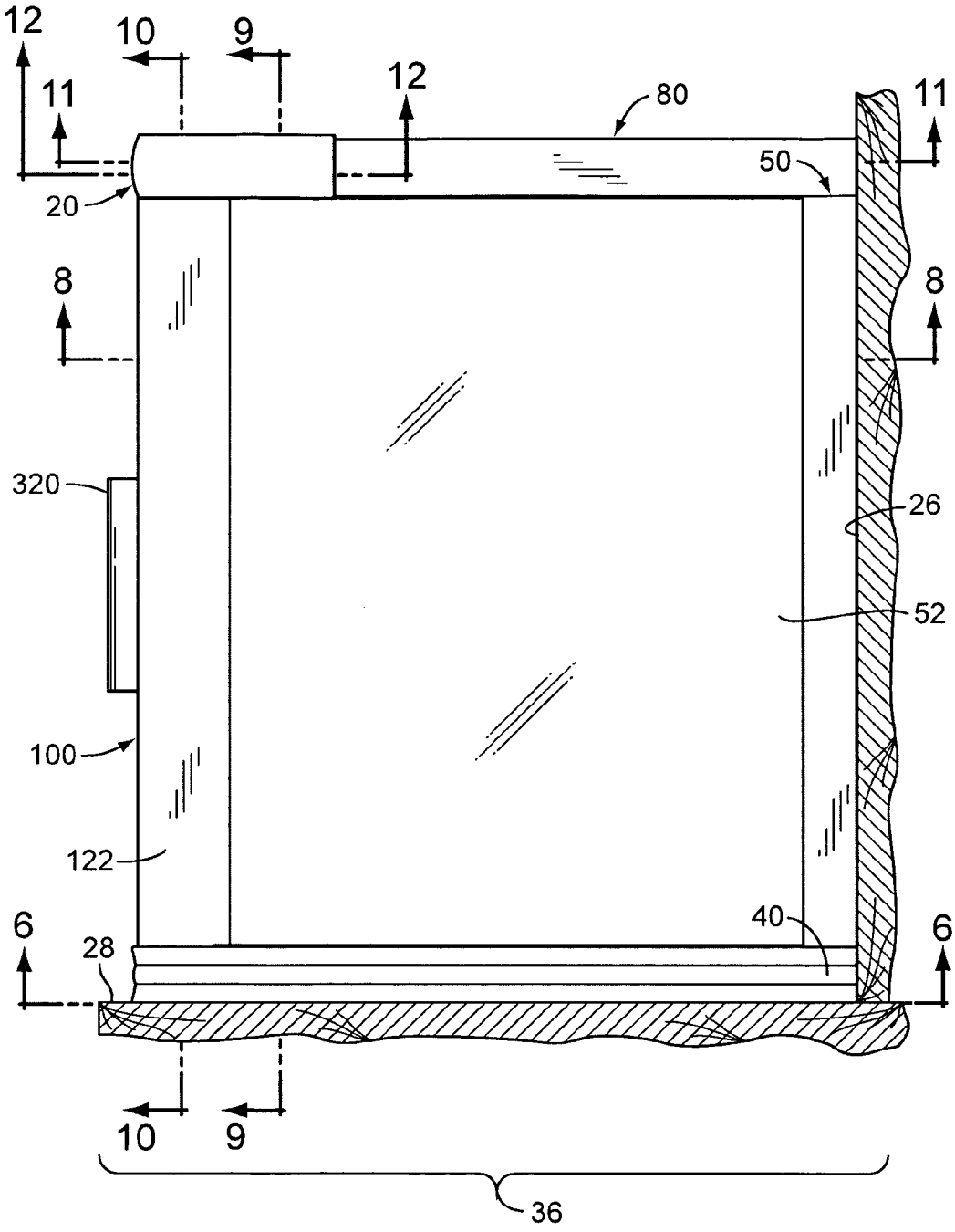
FIG. 5 is a side elevational view taken generally along the plane 5-5 in FIG. 3, but in FIG. 5, the floor and one wall have been shown in fragmentary cross section.

As can be seen in FIG. 4, the sill 240 has a exterior wall 241 having a laterally extending top flange 242, a laterally extending middle flange 243, and a laterally extending bottom flange 244. The sill 240 also has an interior wall 245 with a laterally extending top flange 246, a laterally extending middle flange 247, and a laterally extending bottom flange 248. Joining the exterior wall 241 to the interior wall 245 is a floor or deck 249.

Figure 6:
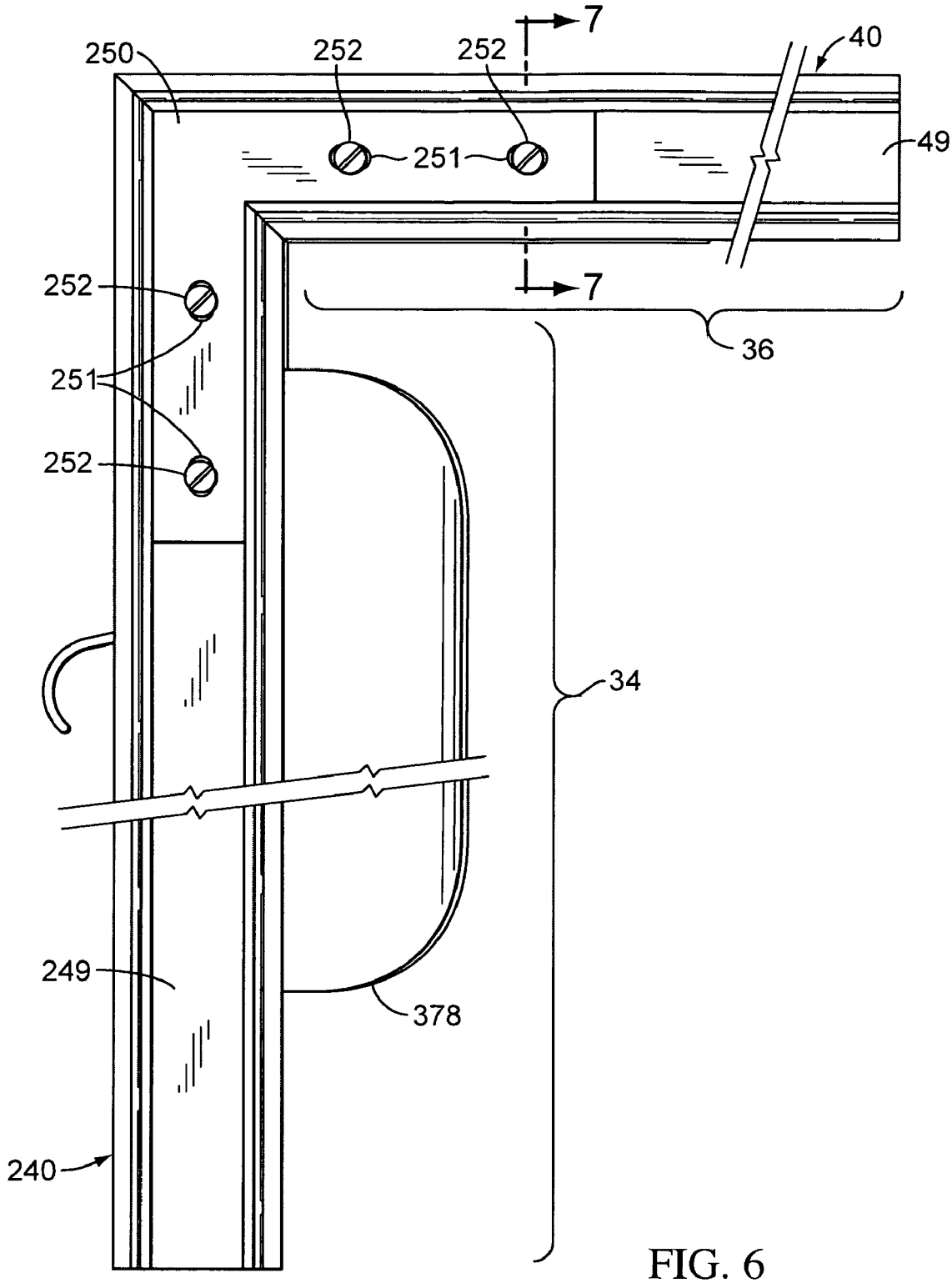
FIG. 6 is a greatly enlarged, cross-sectional view taken generally along the plane 6-6 in FIG. 5 and looking up from the floor toward the bottom of the enclosure.
Figure 7:
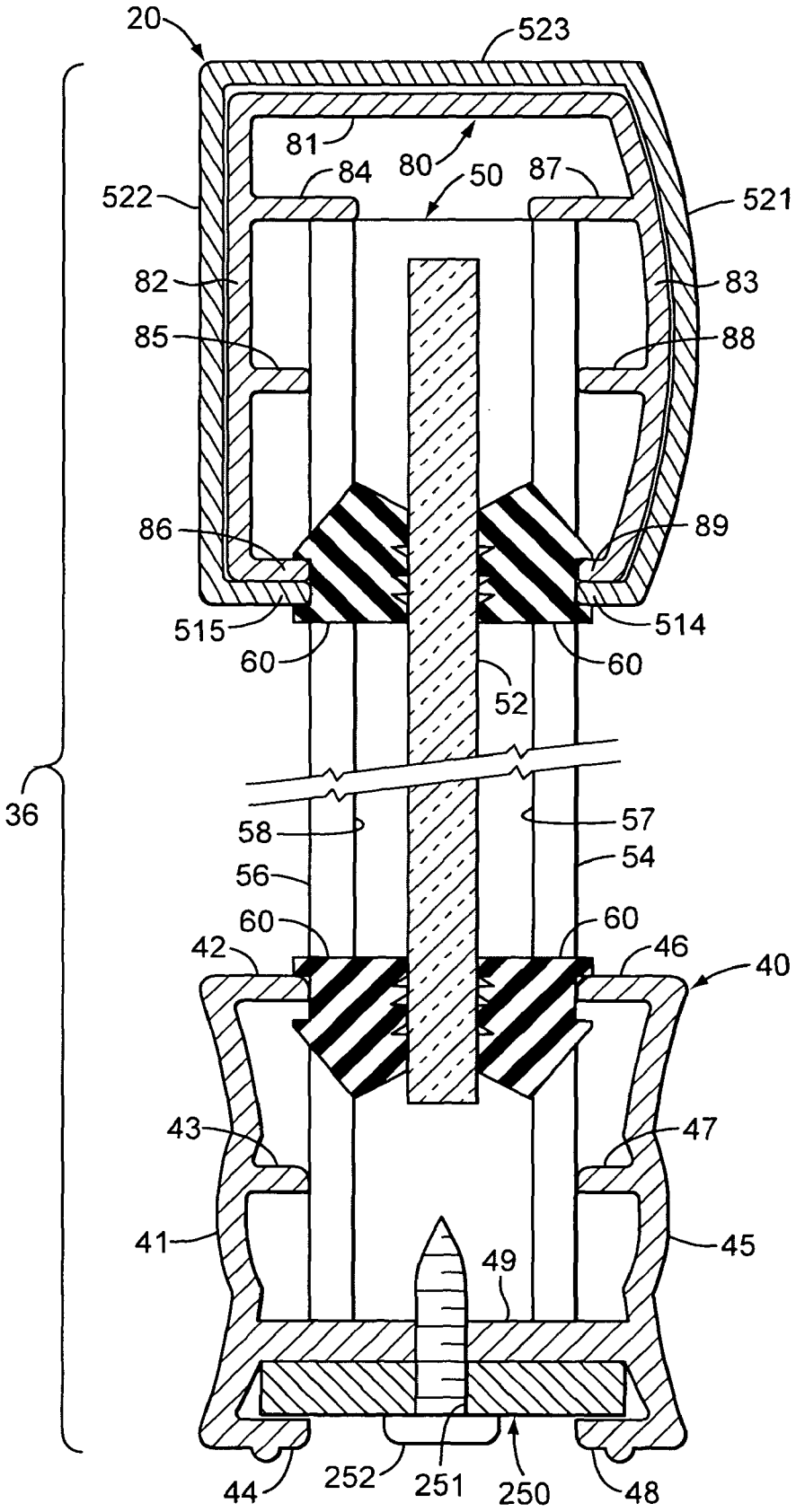
FIG. 7 is a fragmentary, cross-sectional view taken generally along the plane 7-7 in FIG. 6, and in FIG. 7 the top of the enclosure is at the top of the figure and the floor has been omitted for ease of illustration.

As can be seen in FIG. 6, the sills 40 and 240 each has a mitered end at the corner, and the sill mitered end is adapted to receive a 90 degree corner bracket 250 which has one leg disposed in the sill 40 and the other leg disposed in the sill 240. As can be seen in FIG. 7 with respect to the sill 40, one of the legs of the corner bracket 250 is slid under the sill deck 49 in the channels defined by the deck 49 and the bottom flanges 44 and 48. The other leg of the corner bracket 250 is disposed within the other bottom sill 240 in the same manner.

As can be seen in FIGS. 6 and 7, the legs of the corner bracket 250 are each provided with holes 251 for each receiving a screw 252 that can be driven into the sill lower deck (deck 49 in sill 40, and deck 249 in sill 240) to fasten the connector bracket 250 to the sills 40 and 240. Prior to installation of the sills 40 and 240 on the floor or bathtub, the corner bracket 250 is disposed within the mitered ends of the two sills 40 and 240 and secured together with the screws 252. The connected sills 40 and 240 are then mounted at the appropriate location and caulked in place.

At the end of the sill 240 adjacent the wall 24, there is a vertically disposed wall jamb 260 having the same cross-sectional configuration as the other wall jamb 50 described above. With reference to FIG. 8, the jamb 260 has a channel-like cross-sectional configuration with a rear wall 261 that is screwed to the existing wall 24 with appropriate screws (not shown) and wall anchors (not shown) if necessary. Extending outwardly from the jamb rear wall 261 are a pair of spaced-apart legs or sidewalls 264 and 266. The sidewall 266 has a laterally extending lip or flange 267, and the sidewall 264 has a laterally extending lip or flange 268.

With reference to FIG. 4, it can be seen that the bottom of the jamb 260 is disposed within the bottom sill 240. Before the jamb 260 is secured to the existing wall 24, the bottom of the jamb 260 is located within the bottom sill 240 so that the jamb bottom end is mounted on the sill deck 249.

As can be seen in FIG. 1, at the top of the jamb 260 against the existing wall 24, a header 280 is mounted generally horizontally to extend from the existing wall 24 over the door 201 and into the corner connector 20. FIG. 4 shows the top of the jamb 260 within the header 280.

The header 280 has a cross-sectional configuration identical with the cross-sectional configuration of the other header 80 illustrated in FIG. 14. In particular, and with reference to FIG. 4, the header 280 includes a top deck 281, and two downwardly extending, spaced-apart walls—an exterior wall 283 and an interior wall 282. The exterior wall 283 is convex outwardly to match the shape of the exterior wall 83 of the other header 80. Projecting laterally from the interior wall 282 of the header 280 is a top flange 284, a middle flange 285, and a bottom flange 286. Projecting laterally from the convex exterior wall 283 is a top flange 287, a middle flange 288, and a bottom flange 289. The top flanges 284 and 287 of the header 280 locate the header 280 vertically at the upper end of the jamb 260. The middle flanges 285 and 288 and the lower flanges 286 and 289 provide lateral stability.

Typically, after completion of the installation of the enclosure components, the installer caulks vertical, interior edges of the jambs 50 and 260 against the walls and the butt end edges of the headers 80 and 280 against the walls 24.

In the particular enclosure installation illustrated in FIG. 1, the door 201 extends across most of the width of the enclosure side 34 between the wall jamb 260 and the corner post 100. The door may be of any suitable or special configuration, and the detailed design and construction of the door and its mounting framework forms no part of the present invention. Briefly, with reference to FIG. 8, the door is part of the door assembly having a continuous, vertically oriented hinge 300 that includes a mounting channel 302 which is mounted around the jamb walls 264 and 266 and which is attached thereto with suitable screws (not illustrated). The door hinge 300 is attached to a vertical frame member 306 in which is mounted the vertical margin or edge of a glass panel 308. The other, vertical side margin or edge of the glass panel 308 is received in a vertical frame member 310. As can be seen in FIG. 4, the bottom, horizontal margin or edge of the glass panel 308 is received in a bottom frame member 312, and the top, horizontal margin or edge of the glass panel 308 is received in a top frame member 314. As can be seen in FIGS. 4 and 8, vinyl glazing strips 316 seal and secure the glass panel 308 to the door frame members 306, 310, 312, and 314.

The door 201 includes an exterior handle 320 (FIG. 1) and an interior handle 322 (FIG. 2). As can be seen in FIGS. 1 and 8, the door assembly also includes a strike jamb 330 having a channel portion 332 (FIG. 8) for receiving the extending walls 102 and 104 of the attachment portion of the corner post 100. The strike jamb 330 is secured to the corner post walls 102 and 104 with suitable screws (not illustrated). The strike jamb 330 includes a strike flange 334 overlapping a vertical edge portion of the door vertical frame member 310 as can be seen in FIG. 8. The flange 334 and the adjacent edge of the door frame member 310 preferably include magnetic seal strips 338 to hold the door 201 in a closed orientation.

As can be seen in FIG. 4, the lower end of the door bottom frame 312 does not extend all the way down to the bottom sill 240. There is a space between the lower end of the bottom frame member 312 and the top of the bottom sill 240. The top of the bottom sill 240 is closed with a curb fill 360 which may be an aluminum member that snap-fits into the bottom sill top flanges 242 and 246 as shown in FIG. 4. The remaining space between the lower end of the door bottom frame member 312 and the curb fill 360 is blocked on the inside of the enclosure by a polyvinyl drip rail or other flexible sheet 370 which is mounted in a channel on the underside of a drip rail 378 mounted to the interior side of the door bottom frame member 312. The drip rail 378 is typically an aluminum member which may be secured with adhesive or screws (not shown) to the door bottom frame member 312.

As can be seen in FIG. 4, the door top frame member 314 does not extend all the way up to the bottom of the header 280. The open bottom end of the header 280 is closed with a top fill 380 which has the same cross-sectional configuration as the bottom curb fill 360 described above. The top fill 380 is inverted compared to the orientation of the bottom curb fill 360, and the top fill 380 is snap-fit into the bottom flanges 286 and 289 of the header 280. In this particular enclosure design, the open space between the top fill 380 and the top of the door top frame member 314 is left open because substantially no shower water would be at that location above the door 201.

With the exception of the corner connector 20 and headers 80 and 280, the above-described components of the enclosure 22 have conventional designs. The preferred form of the novel corner connector 20 of the present invention is adapted for use with a conventional design of corner post 100 and with the illustrated design of the headers 80 and 280. The particular design and configuration of other components of the enclosure may be varied and form no part of the preferred form of the present invention.

Further, it will be appreciated by one of ordinary skill in the art that the corner connector 20 of the present invention may be readily adapted for use with a corner post and headers that have configurations other than illustrated herein.

Figure 15:
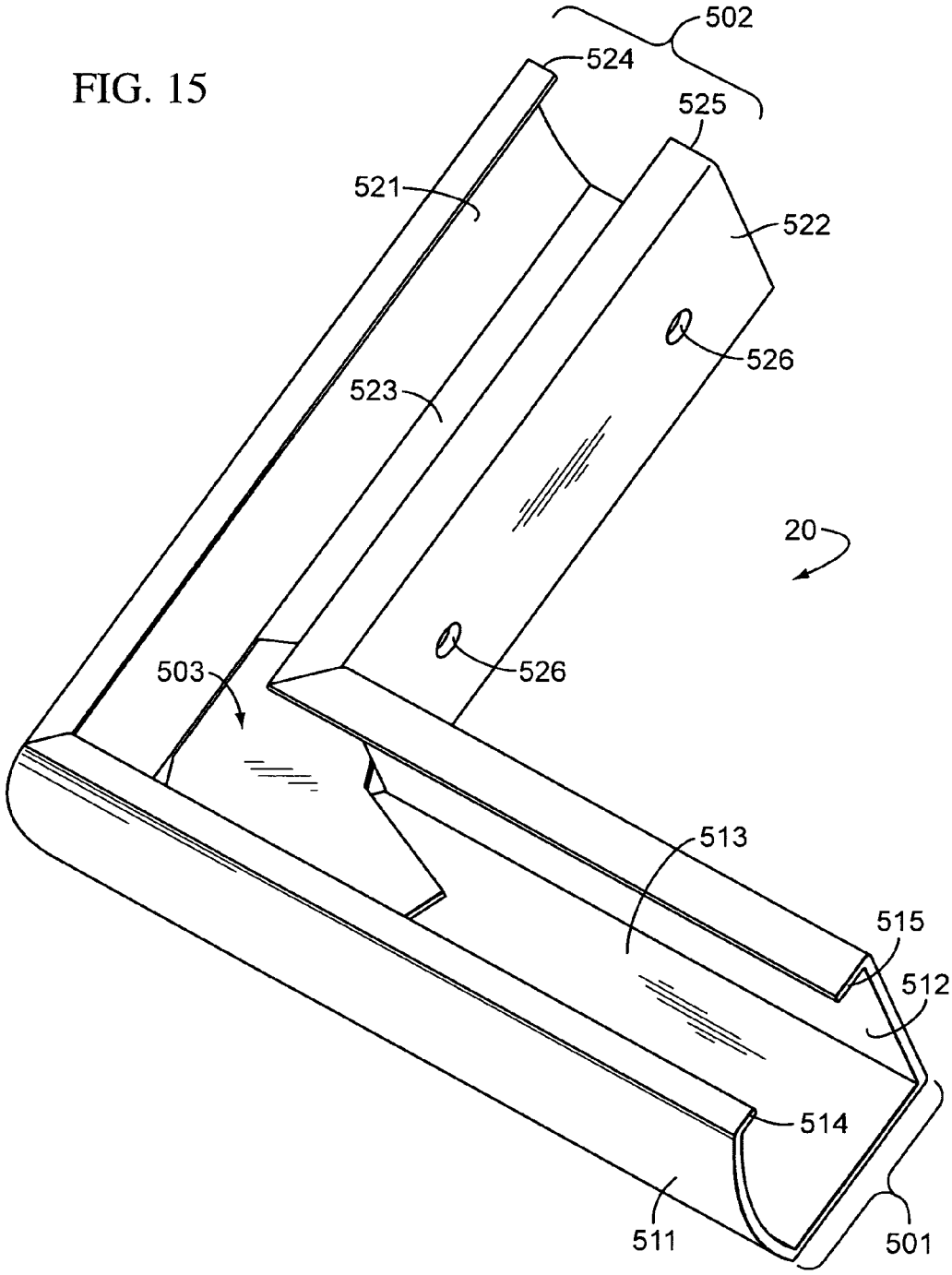
FIG. 15 is an isometric view of the underside of the corner connector of the present invention.
Figure 18:
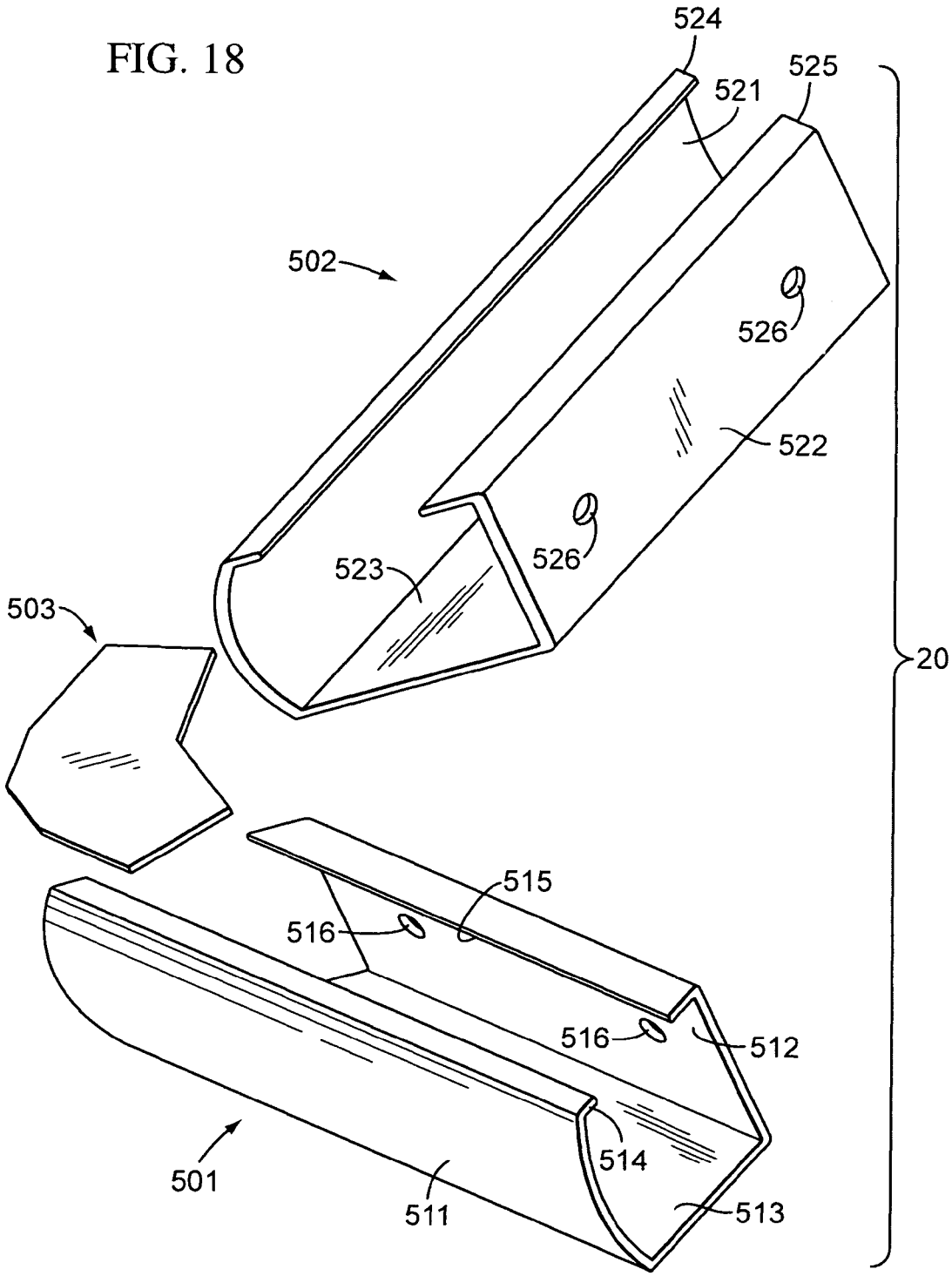
FIG. 18 is an exploded, isometric view of the corner connector of the present invention and showing the corner connector components separated from each other.

FIG. 15 illustrates the corner connector 20 as viewed from the underside. The corner connector 20 has a first leg 501 and a second leg 502. As can be seen in FIG. 18, a presently preferred embodiment of the connector 20 is an assembly of three separate components which include the two legs 501 and 502 joined by a joining plate 503. As can be seen in FIG. 18, the first leg 501 has a pair of sidewall portions—a first sidewall portion 511 and a second sidewall portion 512 which are connected by a top portion 513. The sidewall portion 511 is preferably arcuate or convex to match the curvature of the exterior wall 83 of the header 280. The first sidewall portion has a lower flange 514, and the second sidewall portion has a lower flange 515 which extends toward the first flange 514. The second sidewall portion also defines unthreaded holes 516 for receiving connecting screws as described hereinafter.

The corner connector second leg 502 has a first sidewall portion 521 and a second sidewall portion 522 which are joined by a top portion 523. The second leg first sidewall portion 521 is convex to match the curvature of the exterior wall 83 of the header 80 (FIG. 1). The first sidewall portion 521 has a lower flange 524, and the second sidewall portion 522 has a lower flange 525 which extends toward the flange 524. The second leg second sidewall portion 522 has two unthreaded holes 526 for receiving screws as described hereinafter.

Figure 16:
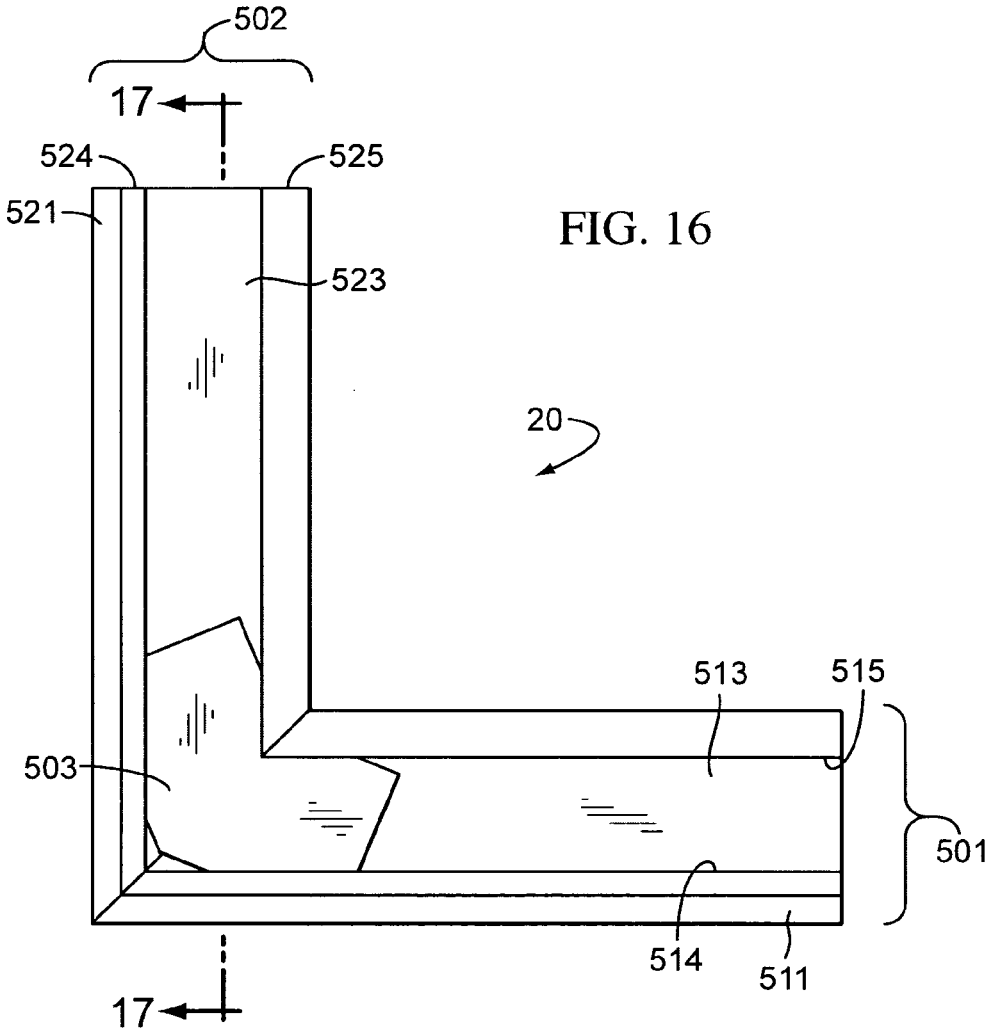
FIG. 16 is a bottom, plan view of the corner connector shown in FIG. 15.
Figure 17:
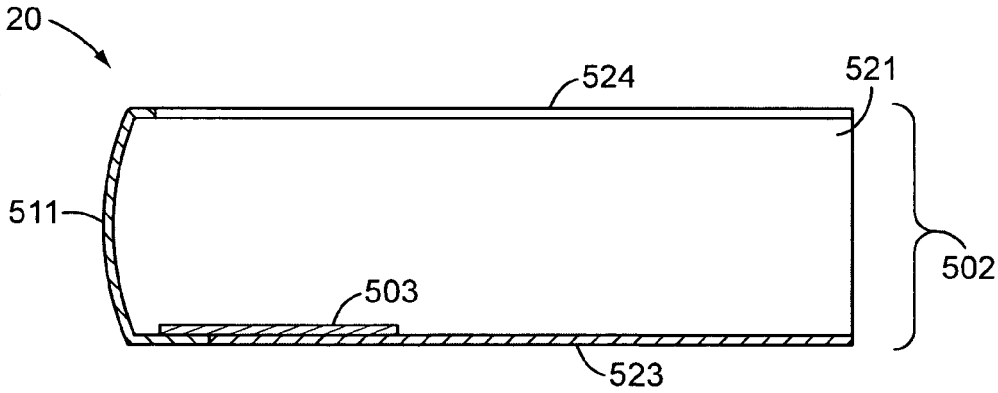
FIG. 17 is a cross-sectional view taken generally along the plane 17-17 in FIG. 16.

As can be seen in FIGS. 15, 16, and 18, one end of the first leg 501 is mitered, and one end of the second leg 502 is mitered. In the preferred embodiment illustrated, the corner connector 20 is adapted for use at a 90 degree corner, and the miter angle on each leg 501 and 502 is 45 degrees. The corner connector legs 501 and 502 are assembled by the manufacturer with the joining plate 503 disposed against the first leg top portion 513 and against the second leg top portion 523. The leg top portions 513 and 523 are preferably planar, at least inside the legs, and the joining plate 502 is preferably planar. In a presently contemplated preferred embodiment, the leg 501, the leg 502, and the joining plate 503 are aluminum, and the joining plate 503 is secured to the leg top portions 513 and 523 with a suitable adhesive, such as an epoxy adhesive.

Each leg 501 and 502 may be regarded has having a proximal end adjacent the miter joint and a distal end. Each leg defines an internal cavity that, when the corner connector is installed, opens downwardly between the proximal end and distal end. The cavity is also open horizontally at the distal end of the leg. The cavity in each leg 501 and 502 is sized to receive both the top end of the corner post 100 and a selected length of an end portion of one of the headers 80 or 280.

The corner connector 20 of the invention facilitates efficient installation of the headers 80 and 280 and provides a strong corner connection system. The corner connector 20 can be provided with a suitable interior configuration as may be necessary to accommodate headers and corner posts having various sizes and configurations. Also, the corner connector 20 of the present invention can be made with a variety of external configurations to provide an aesthetically pleasing design.

Prior to describing process of installing the corner connector 20, the completed installation of the corner connector 20 on the enclosure 22 will next be described.

Figure 11:
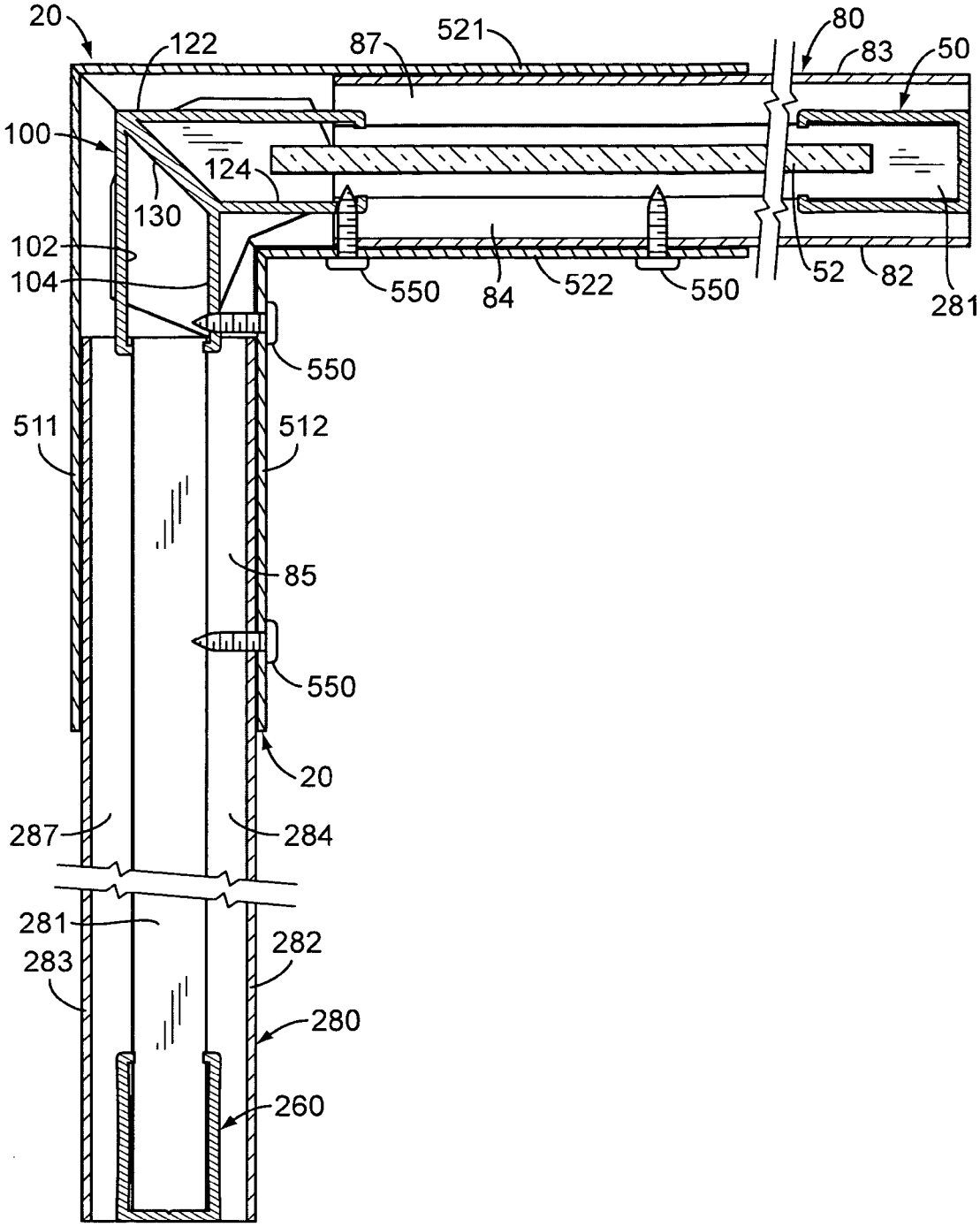
FIG. 11 is a greatly enlarged, fragmentary, cross-sectional view taken generally along the plane 11-11 in both FIGS. 5 and 9, and the view is looking upwardly toward the top of the enclosure.
Figure 12:
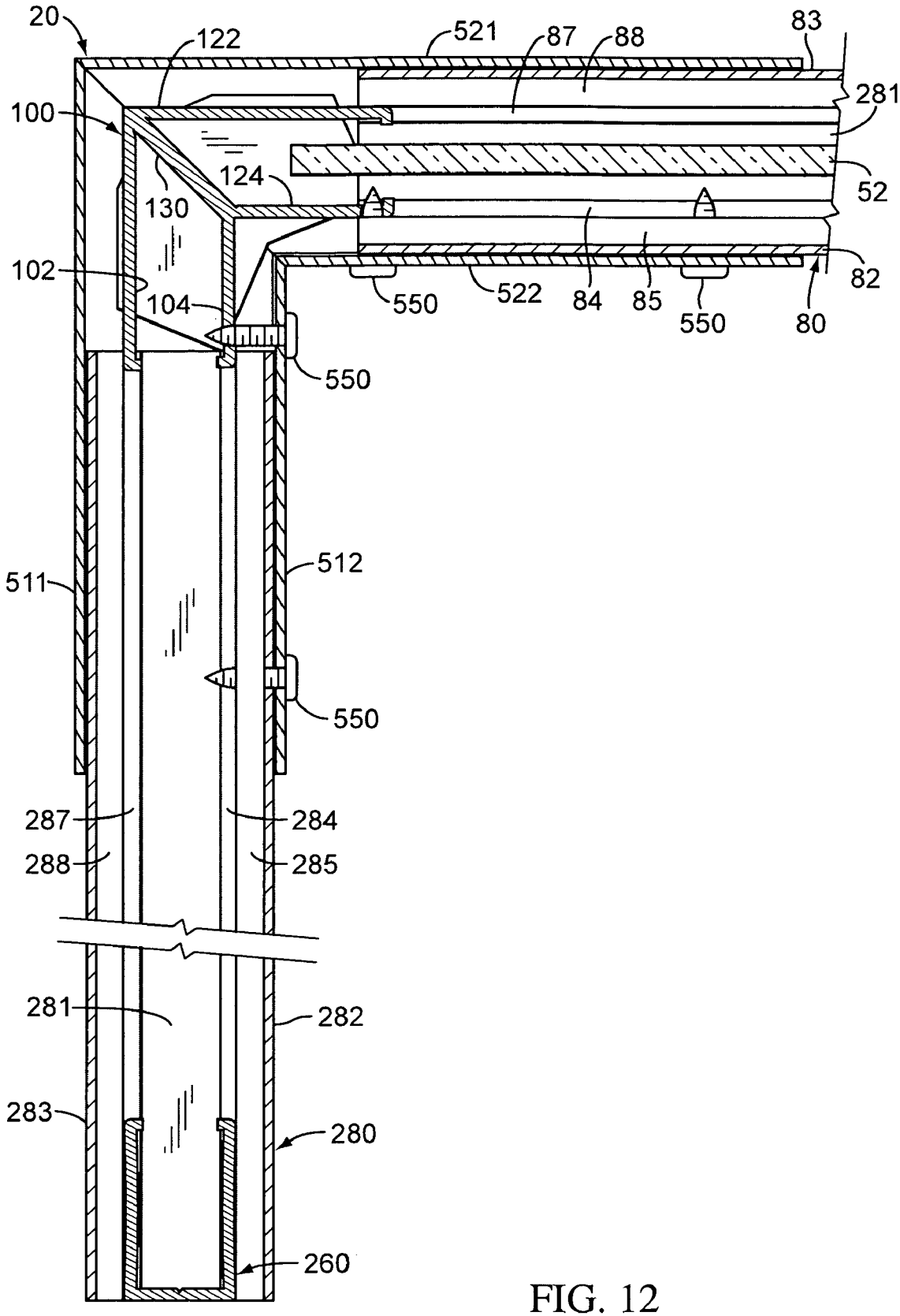
FIG. 12 is a greatly enlarged, fragmentary, cross-sectional view looking up similar to FIG. 11, but in FIG. 12, the view is taken at plane 12-12 in both FIGS. 5 and 9 at a slightly lower elevation than the view in FIG. 11.

As can be seen in FIGS. 11 and 12, the wall members 102 and 104 that comprise the first attachment portion of the corner post 100 are also received in the corner connector 20 (FIG. 11). Analogously, the wall members 122 and 124 which comprise the second attachment portion of the corner post 100 are received in the corner connector 20 (FIGS. 2, 11, and 12).

Figure 9:
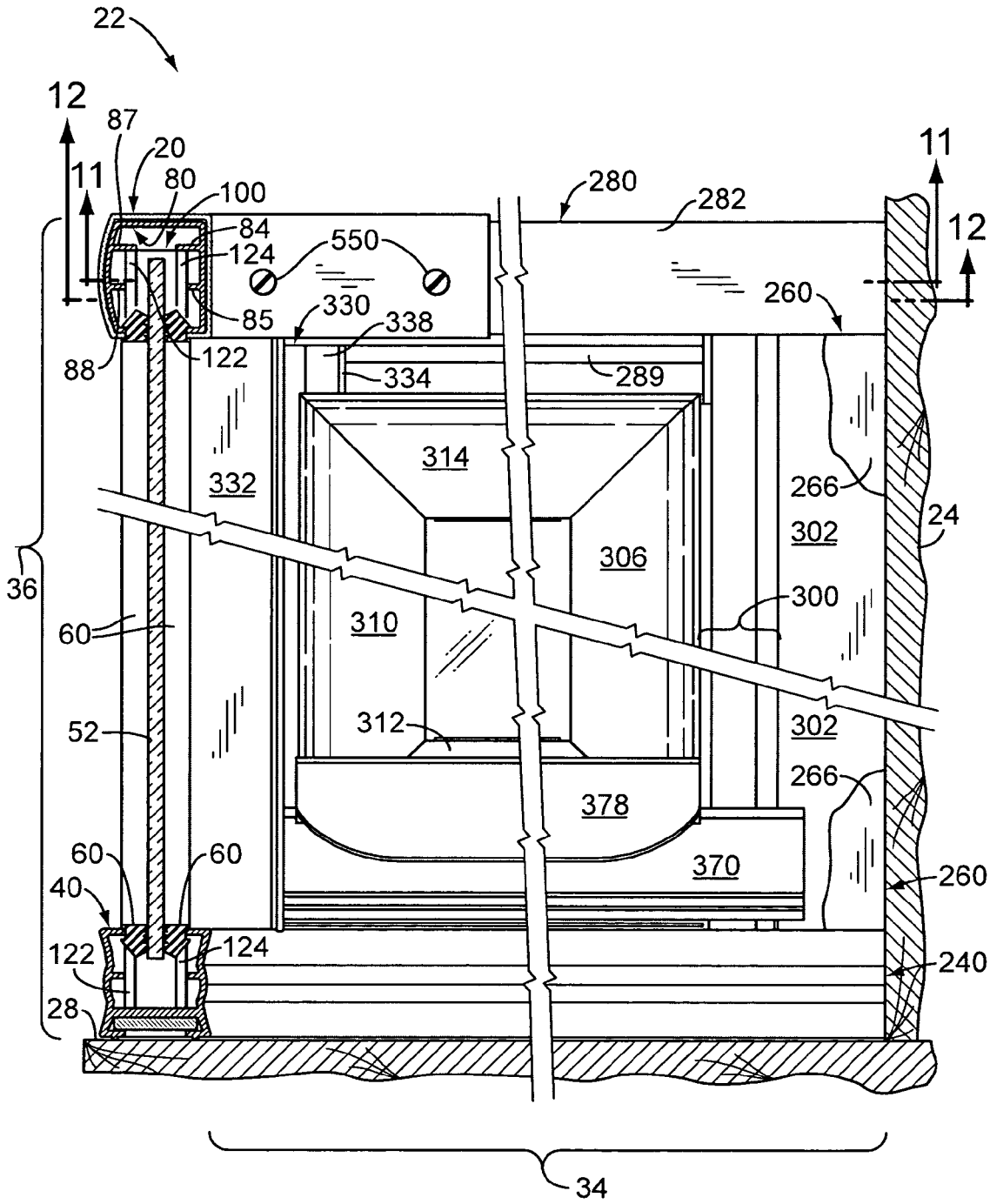
Figure 10:
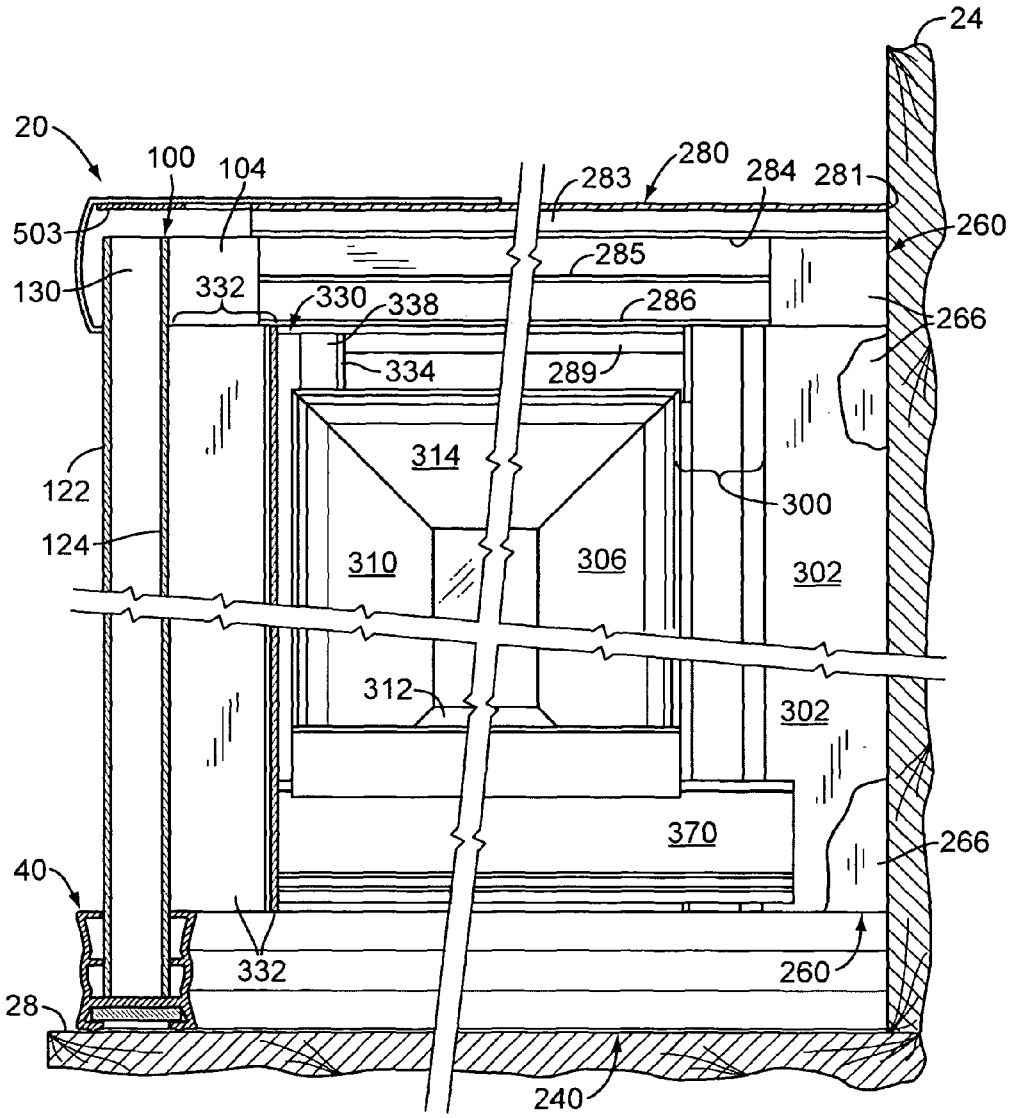
FIG. 10 is a fragmentary, cross-sectional view taken generally along the plane 10-10 in FIG. 5.

As can be seen in FIGS. 2, 11, and 12, a length of the proximal end portion of the header 80 is received between the sidewall portions 521 and 522 that are part of the second leg 502 of the corner connector 20, and a length of the proximal end portion of the other header 280 is received between the walls 511 and 512 that are part of the first leg 501 of the corner connector 20. It will be appreciated that in FIG. 11, the view is taken looking up from just above the header middle flanges (not visible in FIG. 11) and looking up towards the top flanges (i.e., top flanges 84 and 87 of the first header 80 and top flanges 284 and 287 of the header 280). FIG. 12 is taken along the view line 12-12 as shown in FIG. 9, and the view 12-12 is below, and looking up towards, the header middle flanges (i.e., the middle flanges 85 and 88 of the header 80, and the middle flanges 285 and 288 of the other header 280). As can be seen in FIG. 9, the header 80 and the surrounding portion of the corner connector 20 are maintained at a predetermined elevation relative to the corner post 100 by the engagement of the header top flanges 84 and 87 with the top end of the corner connector 100. The middle flanges 85 and 88 of the header 80 provide lateral stability against the sides of the corner connector 100. At the top of the other side of the enclosure, a proximal end portion of the other header 280 and the surrounding portions of the other leg of the corner connector 20 are disposed in an analogous manner at the top of the corner post 100.

As can be seen in FIGS. 9, 11, and 12, screws 550 are disposed through the corner connector holes (holes 516 and 526 in FIG. 18) to threadingly engage interior structure. In particular, with reference to FIG. 11, the header 80 is fastened with two screws 550 to the corner connector interior wall 522, and one of those screws 550 also extends far enough to threadingly connect with the wall member 124 of the corner post 100. However, at the other side of the enclosure, the other header 280 is threadingly engaged with only one of the screws 550 to secure it to the interior wall 512 of the corner connector. The proximal end of the header 280 is not located far enough into the corner connector 20 to be engaged by the second screw 550. However, that second screw 550 in the corner connector interior wall 512 does also extend through to the interior wall member 104 of the corner post 100. The distance that each header 80 and 280 extends into the corner connector 20 depends upon the length of the header and the distance from the corner of the enclosure to the existing wall (i.e., existing wall 24 or 26). Preferably, the manufacturer provides the headers with a sufficient standard length for the particular standard size enclosure 22 that is being installed so that at least one of the two screws 550 on each leg of the corner connector 20 will be able to engage an end portion of each header. However, it is not necessary for either header to extend far enough to be threadingly engaged by the second screw 550. In another contemplated alternate embodiment (not illustrated), only one screw would be provided for each leg of the corner connector to connect both the corner connector leg and header to the corner post. In yet another contemplated embodiment, more than two screws could be provided for each leg of the corner connector. Also, fastening systems other than screws could be employed.

Preferably, however, if screws are used, at least one of the screw-receiving holes 516 in each leg of the corner connector 20 is located close enough to the enclosure corner so that the inserted screw 550 will threadingly engage the adjacent portion of the top of the corner post 100 (i.e., the adjacent attachment portion wall member 104 or the adjacent attachment portion wall member 124). The corner connector 20 accommodates significant variation in the length of the proximal end portion of the header that is received within the corner connector 20, and this provides the installer with a great latitude in using a pre-cut, standard length header without having to measure and cut a longer header shorter at the installation site to accommodate variations in distance to the existing room wall (which wall may not be vertically straight and plumb, and therefore may be closer to the enclosure corner or further away from the enclosure corner than at the bottom of the existing room wall where the sills 40 and 240 have been installed).

The use of the novel corner connector 20 also permits the manufacturer to provide each header with both ends cut straight across (perpendicular to the length of the header). No special miter cut end is required. Thus, the installer does not have to carefully measure and cut the other ends of the headers to ensure that a miter joint will fit properly.

The preferred embodiment of the novel corner connector of the present invention illustrated in FIGS. 7 and 15 accommodates efficient and effective sealing of the stationary glass panel 52 adjacent the corner post 100. This is effected by the corner connector lower flanges 514, 515, 524, and 525 (FIG. 15). These flanges extend for a specific distance laterally (i.e., project from the sidewall portions). As can be seen in FIG. 7 with respect to the corner connector second leg lower flanges 514 and 515, the distal end of each lower flange is in vertical registration with the distal end of the overlying bottom flange of the header 80. That is, the projecting, distal end the header bottom flange 86 is in vertical registration with the corner connector lower flange 515, and the distal end of the header bottom flange 89 is in vertical registration with the distal end of the corner connector lower flange 514. The aligned distal ends of these sets of flanges properly engage the polyvinyl seal strip 60 and hold it securely and tight engagement against the glass panel 52. An identical arrangement exists with respect to the other leg of the corner connector 20 around the other header 280.

The corner connector 20 of the present invention allows the installer of the enclosure to efficiently construct a reliable top corner connection on the enclosure. The corner connector can be used with any enclosure having (1) a suitable corner post on which the corner connector 20 can be mounted to hold one end of each of the headers 80 and 280, and (2) two suitable wall jambs 50 and 260 (one at each existing wall) so that the other end of each header can be mounted on the corresponding one of the jambs.

According to one aspect of the present invention, a method is provided for connecting at least two headers at the top of an enclosure (which has at least a generally horizontal first header 280, and a generally horizontal second header 80, a first jamb 260 at a first existing wall 24, a second jamb 50 at a second existing wall 26, and a corner post 100 which has (i) a first attachment portion extending toward the first existing wall, (ii) a second attachment portion extending toward the second existing wall, and (iii) which terminates in a top end. One form of the method broadly includes the following steps:

(A) providing the corner connector 20 that includes the first leg 501 and the second leg 502 wherein the first leg 501 has a proximal end, a distal end, and an interior cavity that (i) is open at the first leg distal end, (ii) is also open downwardly between the first leg distal end and the first leg proximal end, and (iii) is sized to receive both the top end of the corner post first attachment portion (e.g., wall members 102 and 104) and a selected length of an end portion of the first header 280 when the first header 280 is inserted lengthwise into the first leg cavity so as to minimize non-lengthwise movement of the first header 280 relative to the first leg 501; and the second leg 502 has a proximal end, a distal end, and an interior cavity that (i) is open at the second leg distal end, (ii) is also open downwardly between the second leg distal end and the second leg proximal end, and (iii) is sized to receive both the top end of the corner post second attachment portion (e.g., wall members 122 and 124) and a selected length of an end portion of the second header when the second header 80 is inserted lengthwise into the second leg cavity so as to minimize non-lengthwise movement of the second header 80 relative to the second leg 502;

(B) creating a top subassembly by (i) inserting an end portion of the first header 280 partway into the corner connector first leg 501, and (ii) before, during, or after step (B)(i), inserting an end portion of the second header 80 partway into the corner connector second leg 502;

(C) mounting the top subassembly at the top end of the corner post so that (i) the top end of the first attachment portion of the corner post 100 is received in the corner connector first leg interior cavity, and (ii) the top end of the second attachment portion of the corner post 100 is received in the corner connector second leg interior cavity;

(D) extending the first header 280 relative to the corner connector 20 to engage the first existing wall 24, and mounting the extended first header 280 on the first jamb 260;

(E) before, during, or after step (D), extending the second header 80 relative to the corner connector 20 to engage the second existing wall 26, and mounting the extended second header 80 on the second jamb 50;

(F) before, during, or after either or both of steps (D) and (E), securing the corner connector 20 to the corner post 100;

(G) before, during, or after step (F), but after steps (A)-(E), securing the first and second headers 280 and 80 to the enclosure first and second jambs 260 and 50, respectively; and (H) before, during, or after step (G), but after steps (A)-(E) securing the corner connector first and second legs 501 and 502 to the first and second headers 280 and 80, respectively.

In a preferred form of the method, step (F) is performed after steps (D) and (E), step (G) is performed after step (F), and step (H) is performed after step (G).

The enclosure 22 typically includes additional components, such as the sills, door, glazing, etc., as described above. One particular method for installing such additional components along with the above-discussed corner connector 20 involves first connecting the sills 40 and 240 with the bottom corner bracket 250 (FIG. 6) and then sealing the sills 40 and 240 in place with caulk (not illustrated).

Next, the wall jambs 50 and 260 are set into the sills 40 and 240, respectively. The wall jambs 50 and 260 are secured to the walls 26 and 24, respectively, with appropriate fasteners (not illustrated).

Setting blocks (not illustrated) are placed in the sills 40 and 240 a few inches from the mitered corner and a few inches from each wall 24 and 26. The glass panel 52 is set in place, and the corner post 100 is positioned at one vertical edge of the glass panel 52.

The headers 80 and 280 are inserted into the legs of the corner connector 20, but not yet attached with the screws. The subassembly of the corner connector 20 and headers 80 and 280 is set down on the top of the corner post 100. The headers 80 and 280 are extended to the existing walls 26 and 24, respectively, and set down over the tops of the wall jambs 50 and 260, respectively.

The corner post 100 is properly positioned vertically (typically by using a level). After insuring that the headers 80 and 280 are extended all the way to the existing walls, the corner connector 20 is preferably secured to the top of the corner post 100 with screws (not illustrated), and the headers 80 and 280 are secured to the tops of the wall jambs 50 and 260, respectively, with screws (not illustrated).

After checking that the corner post 100 is vertical (typically with a level), the corner connector 20 is also secured to the headers 80 and 280 with screws. It may be optionally desirable to also secure one or both of the headers 80 and 280 to the corner post 20 if an end of the header overlaps a portion of corner post (as is the case for the header 80 shown in FIG. 12).

If desired, the order of attaching the corner connector 20 to the post, wall jambs, and headers could be altered so long as the connections between the corner connector 20 and the post

100, the connections between the corner connector and the headers, and the connections between the headers and the wall jambs result in the final orientation of the corner post 100 being substantially plumb and vertical and result in the headers 80 and 280 being extended sufficiently to abut the walls 26 and 24, respectively.

After the corner connector 20, header 80, and other header 280 have been properly secured at the tops of the enclosure corner post 100 and jambs 50 and 260, the door assembly 201 can be mounted to the wall jamb 260 with screws (not illustrated). The strike jamb 330/332 can then be positioned on the corner post, but not yet secured thereto. The curb fill 360 can be positioned against the hinge jamb of the door and snapped into place on the bottom sill (FIG. 4). Similarly, the top fill 380 can be snapped into place in the bottom of the header 280 (FIG. 4).

Then the strike jamb 320/332 can be pulled flush against the fills 360 and 380 and secured.

The horizontal glazing strips 60 (FIG. 7) and vertical glazing strips 60 (FIG. 8) can be cut as may be necessary and installed.

Then the drip rail 378 (FIG. 2) can be secured, along with the vinyl drip rail 370 (FIG. 2), to the door panel with screws.

Finally, all edges and joints exposed to water can be caulked with a suitable sealant.

The corner connector 20 of the present invention can be provided in an angled configuration other than the illustrated 90° angle configuration. For example, an enclosure could have two sides oriented at a 135° angle (not illustrated). For such an enclosure, the corner connector would also be provided with a 135° angle configuration.

It will be appreciated by one of ordinary skill in the art that the enclosure bottom sills 40 and 240 (and the internal bracket 250) could be replaced by new sills having the configuration of the top headers 80 and 280 joined by a connector having the configuration of the top corner connector 20. In such an arrangement, a second set of headers 80 and 280 (identical to the top headers 80 and 280, respectively) joined in a second corner connector 20 would be mounted on the floor 28 upside down to replace the sills 40 and 240 and internal bracket 250. The wall jambs 50 and 260, and the corner post 100 could be mounted in such upside down components in substantially the same manner as described above with respect to the mounting of the jambs 50 and 260 and corner post 100 in the illustrated bottom sills 40 and 240.

It will be apparent that the above-described embodiments, as well as other variations and modifications as come within the scope of the appended claims, can be considered part of the present invention without departing from the true spirit and scope of the novel concepts or principles of this invention.

What is claimed is:

1. A corner connector assembly for an enclosure for a shower or a tub/shower, comprising: (a) a generally horizontal first header, (b) a generally horizontal second header, (c) a generally vertical first jamb at a first existing first wall, (d) a generally vertical second jamb at a second existing wall, and (e) a generally vertical corner post that (i) has a first attachment portion extending toward the first existing wall, (ii) has a second attachment portion extending toward said second existing wall, and (iii) terminates in a top end, and (f) a corner connector comprising:

a first leg having a proximal end, a distal end, and an interior cavity that (i) is open at said first leg distal end, (ii) is also open downwardly between said first leg distal end and said first leg proximal end, and (iii) is sized to receive both the top end of said corner post first attachment portion and a selected length of an end portion of said first header when said first header is inserted lengthwise into said first leg cavity so as to minimize non-lengthwise movement of said first header relative to said first leg; and a second leg having a proximal end, a distal end, and an interior cavity that (i) is open at said second leg distal end, (ii) is also open downwardly between said second leg distal end and said second leg proximal end, and (iii) is sized to receive both the top end of said corner post second attachment portion and a selected length of an end portion of said second header when said second header is inserted lengthwise into said second leg cavity so as to minimize non-lengthwise movement of said second header relative to said second leg, in which said corner connector is adapted for use with said first and second headers which each has a pair of laterally extending bottom flanges that are spaced apart, parallel, and extend toward each other in a common plane;

said corner connector first leg and second leg each has a pair of sidewall portions connected by a top portion;

said corner connector first leg sidewall portions each has a lower flange extending toward the other lower flange in a common plane for being received under one of said first header bottom flanges;

said corner connector second leg sidewall portions each has a lower flange extending toward the other lower flange in a common plane for being received under one of said second header bottom flanges; and the lateral projection of each said lower flange of said corner connector is such that when said first and second headers are inserted in said corner connector first and second legs, respectively, the distal end of each said lower flange of said corner connector is in vertical registration with the distal end of the overlying bottom flange of the associated header.

2. The corner connector assembly as set forth in claim 1 in which said first and second legs diverge from each other at a generally 90 degree angle.

3. The corner connector assembly as set forth in claim 1 in which said corner connector first leg proximal end is a mitered end; and said corner connector second leg proximal end is a mitered end in end-to-end abutting relationship with said first leg mitered end.

4. The corner connector assembly as set forth in claim 3 in which said corner connector first leg has a top portion joining two, spaced-apart sidewall portions;

said corner connector second leg has a top portion joining two, spaced-apart sidewall portions; and said corner connector includes a joining plate adhesively secured to said corner connector first leg top portion and to said corner connector second leg top portion.

5. The corner connector assembly as set forth in claim 4 in which part of said joining plate lies between said corner connector first leg sidewall portions, and part of said joining plate lies between said corner connector second leg sidewall portions.

6. The corner connector assembly as set forth in claim 5 in which said corner connector is aluminum; and said joining plate is aluminum.

7. A method for connecting headers at the top of an enclosure for a shower or a tub/shower wherein the enclosure has at least (a) a generally horizontal first header, and (b) a generally horizontal second header, (c) a generally vertical first jamb at a first existing wall, (d) a generally vertical second jamb at a second existing wall, and (e) a generally vertical corner post that (i) has a first attachment portion extending toward said first existing wall, (ii) has a second attachment portion extending toward said second existing wall, and (iii) terminates in a top end, said method comprising the steps of (A) providing a corner connector that includes a first leg having a proximal end, a distal end, and an interior cavity that (i) is open at said first leg distal end, (ii) is also open downwardly between said first leg distal end and said first leg proximal end, and (iii) is sized to receive both the top end of said corner post first attachment portion and a selected length of an end portion of said first header when said first header is inserted lengthwise into said first leg cavity so as to minimize non-lengthwise movement of said first header relative to said first leg; and a second leg having a proximal end, a distal end, and an interior cavity that (i) is open at said second leg distal end, (ii) is also open downwardly between said second leg distal end and said second leg proximal end, and (iii) is sized to receive both the top end of said corner post second attachment portion and a selected length of an end portion of said second header when said second header is inserted lengthwise into said second leg cavity so as to minimize non-lengthwise movement of said second header relative to said second leg;

(B) creating a top subassembly by (i) inserting an end portion of said first header partway into said corner connector first leg, and (ii) before, during, or after step (B)(i), inserting an end portion of said second header partway into said corner bracket second leg;

(C) mounting said top subassembly at the top end of said corner post so that (i) the top end of said corner post first attachment portion is received in said corner connector first leg interior cavity, and (ii) the top end of said corner post second attachment portion is received in said corner connector second leg interior cavity;

(D) extending said first header relative to said corner connector to engage said first existing wall, and mounting said extended first header on said first jamb;

(E) before, during, or after step (D), extending said second header relative to said corner connector to engage said second existing wall, and mounting said extended second header on said second jamb;

(F) before, during, or after either or both of steps (D) and (E), securing said corner connector to said corner post;

(G) before, during, or after step (F), but after steps (A)-(E), securing said first and second headers to said enclosure first and second jambs, respectively; and (H) before, during, or after step (G), but after steps (A)-(E) securing said corner connector first and second legs to said first and second headers, respectively.

8. The method in accordance with claim 7 in which step (F) is performed after steps (D) and (E); step (G) is performed after step (F); and step (H) is performed after step (G).

9. The method in accordance with claim 7 in which step (F) includes (i) fastening said corner connector first leg to said corner post first attachment portion with at least one screw, and (ii) fastening said corner connector second leg to said corner post second attachment portion with at least one screw.

10. The method in accordance with claim 7 in which step (G) includes fastening said first and second headers to said first and second jambs, respectively, with screws.

11. The method in accordance with claim 7 in which step (H) includes fastening said corner connector first and second legs to said first and second headers, respectively, with screws.

12. The corner connector as set forth in claim 1 in which said corner connector lower flanges are each substantially parallel to said corner connector first leg top portion and to said corner connector second leg top portion.

* * * * *